US010178479B2

(12) United States Patent
Permanian

(10) Patent No.: US 10,178,479 B2
(45) Date of Patent: Jan. 8, 2019

(54) SPEAKER DRIVER

(71) Applicant: Jeffrey K. Permanian, Kenosha, WI (US)

(72) Inventor: Jeffrey K. Permanian, Kenosha, WI (US)

( * ) Notice: Subject to any disclaimer, the term of this patent is extended or adjusted under 35 U.S.C. 154(b) by 188 days.

(21) Appl. No.: 15/284,732

(22) Filed: Oct. 4, 2016

(65) Prior Publication Data

US 2017/0070823 A1 Mar. 9, 2017

Related U.S. Application Data

(63) Continuation-in-part of application No. 13/843,893, filed on Mar. 15, 2013, now Pat. No. 9,485,586.

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 7/12*** | (2006.01) |
| ***H04R 9/04*** | (2006.01) |

(52) U.S. Cl.

CPC ..... *H04R 9/025* (2013.01); *H04R 7/12* (2013.01); *H04R 7/18* (2013.01); *H04R 9/041* (2013.01); *H04R 9/043* (2013.01); *H04R 9/06* (2013.01); *H04R 2400/11* (2013.01)

(58) Field of Classification Search

CPC . H04R 7/12; H04R 7/18; H04R 9/025; H04R 9/041; H04R 9/043; H04R 9/06; H04R 2209/024; H04R 2400/11; H04R 9/063

USPC ..... 381/182, 401, 403, 404, 405, 412, 414, 381/420, 421, 433

See application file for complete search history.

(56) References Cited

U.S. PATENT DOCUMENTS

| | | | | |
|---|---|---|---|---|
| 5,604,815 | A * | 2/1997 | Paddock | H04R 9/025 381/182 |
| 6,044,925 | A | 4/2000 | Sahyoun | |
| 6,940,992 | B2 * | 9/2005 | Stiles | H04R 9/025 381/412 |
| 7,831,059 | B1 | 11/2010 | Sahyoun | |
| 8,249,291 | B2 * | 8/2012 | Hyde | H04R 9/063 381/401 |
| 9,485,587 | B1 * | 11/2016 | Skramstad | H04R 9/046 |
| 9,712,921 | B2 | 7/2017 | Salvatti | |

* cited by examiner

*Primary Examiner* — Huyen D Le
(74) *Attorney, Agent, or Firm* — Patricia A. Meier

(57) ABSTRACT

A speaker driver with a high degree of symmetry for use in a loudspeaker is disclosed. The disclosed motor assembly may be symmetrical about its long and radial axes. A voice coil disclosed may be supported by opposing upper and lower suspension members on the voice coil upper and lower ends. The upper and lower voice coil suspension members disclosed may be adhered to a frame above and below the motor assembly, respectively in a mirror like fashion being symmetrical about their long and radial axes. An open voice coil frame disclosed may use elongate structural members having a shape similar to the letter "j" (j-beams) defining large interconnected air gaps to promote cooling of the voice coil.

13 Claims, 16 Drawing Sheets

FIG. 1
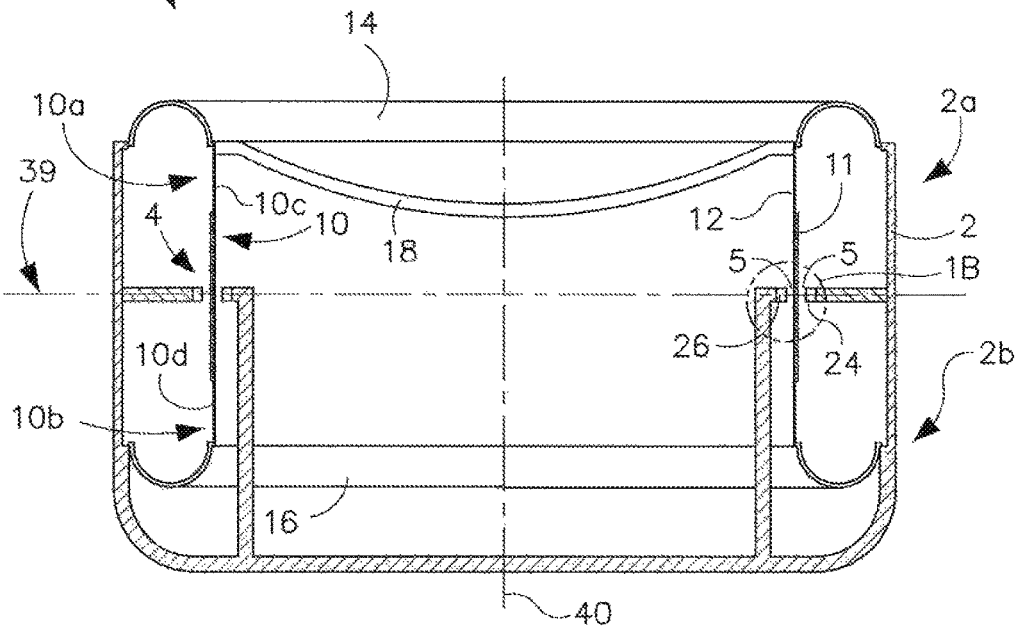
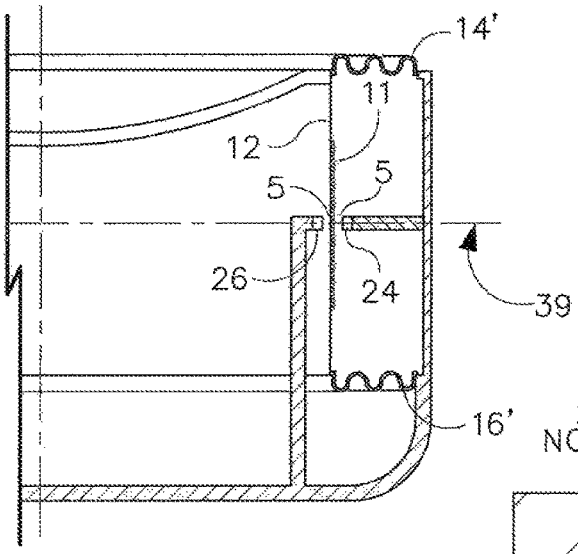
FIG. 1A
FIG. 1B
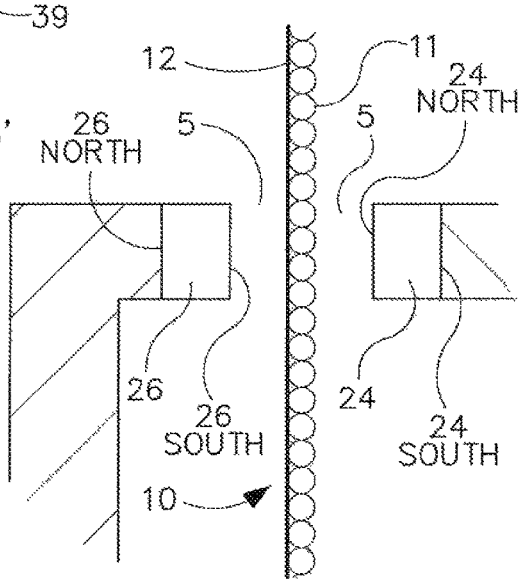

FIG. 4
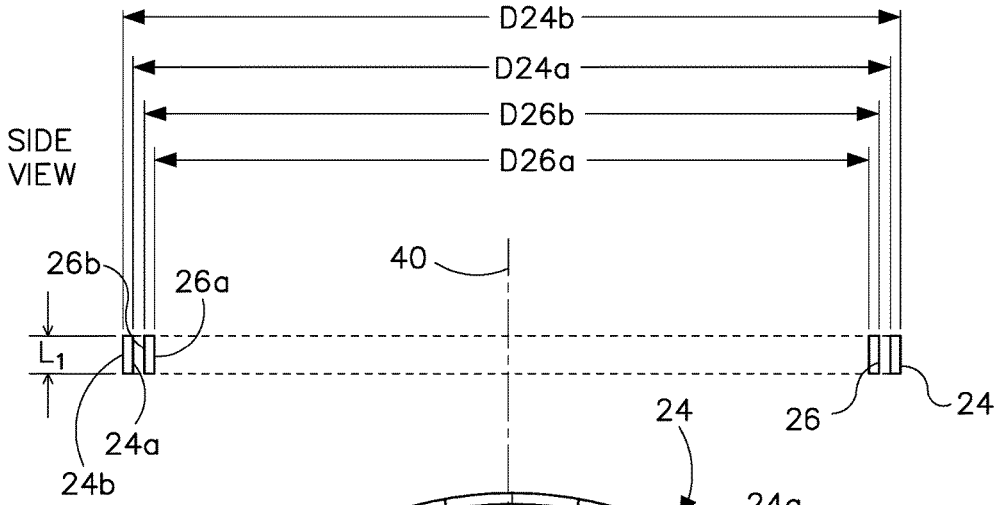
FIG. 4B
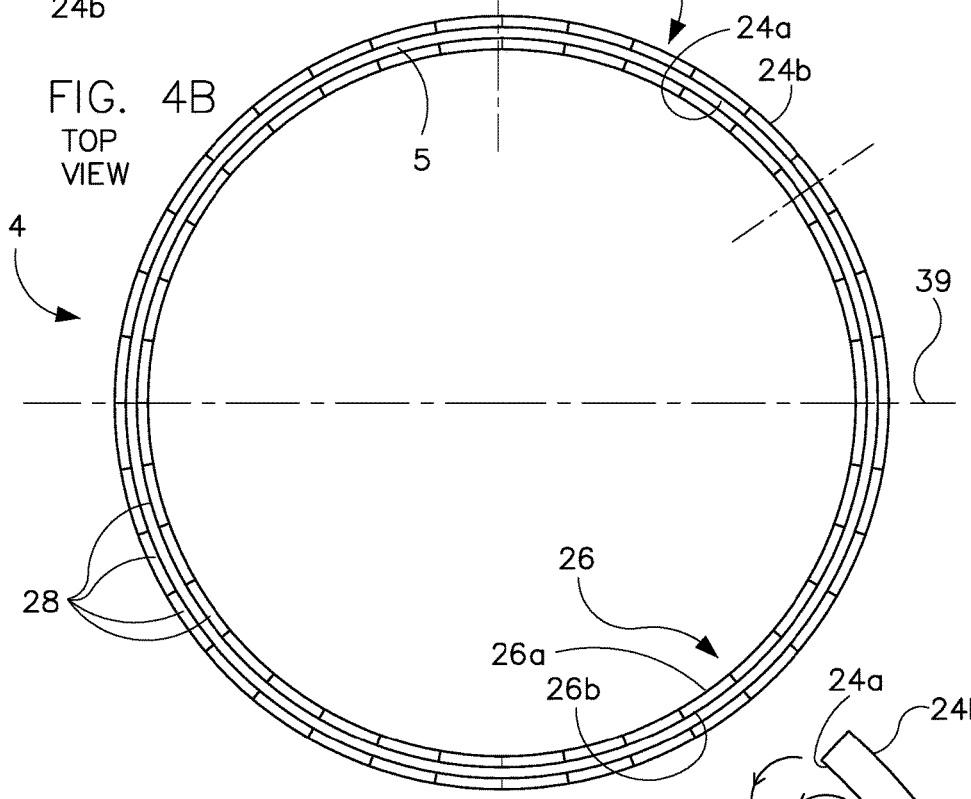
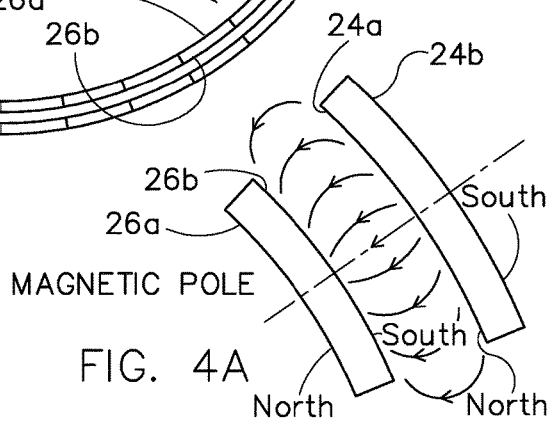
FIG. 4A

FIG. 10
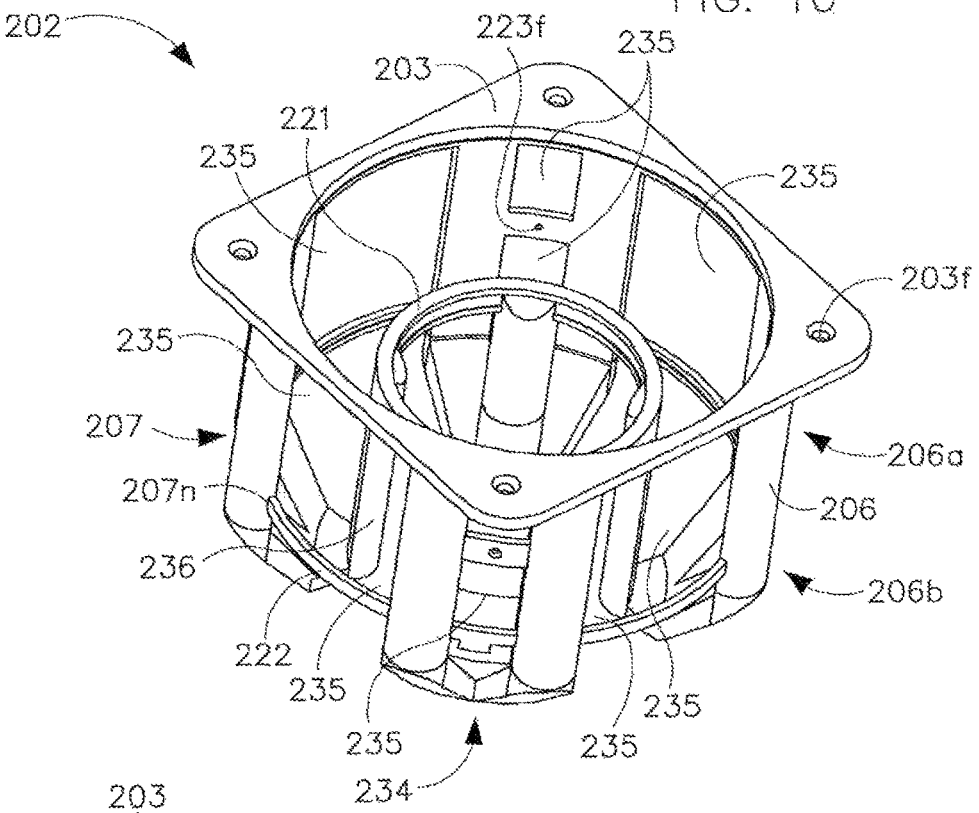
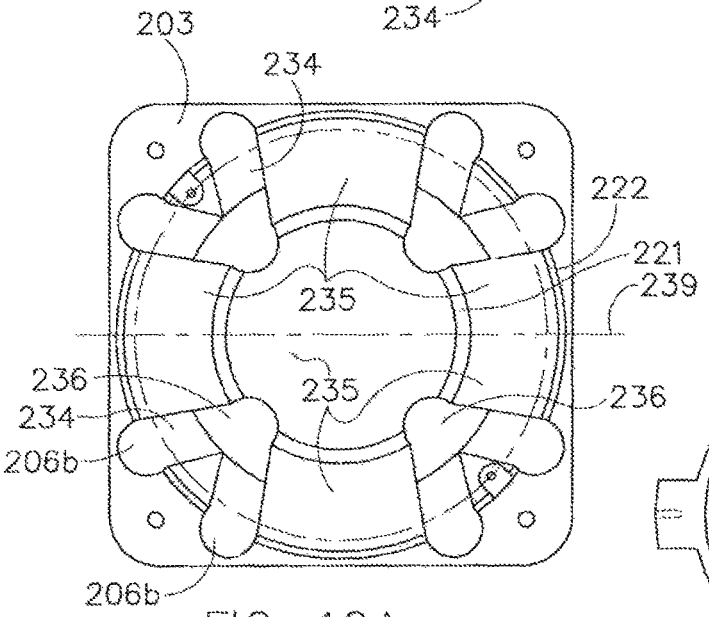
FIG. 10A
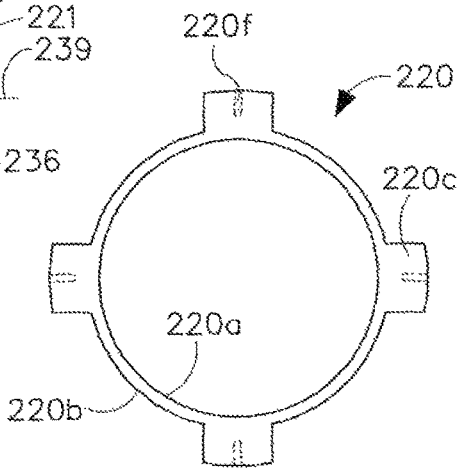
FIG. 10B

FIG. 12B
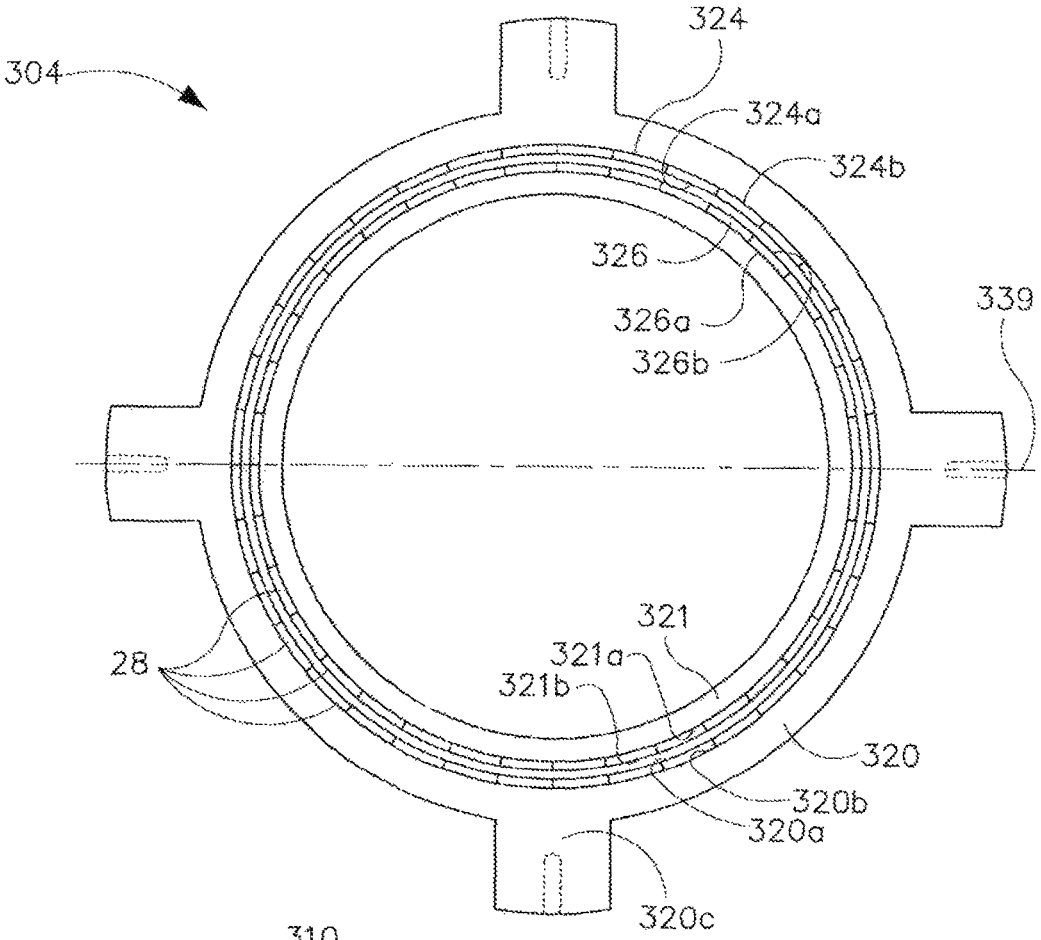
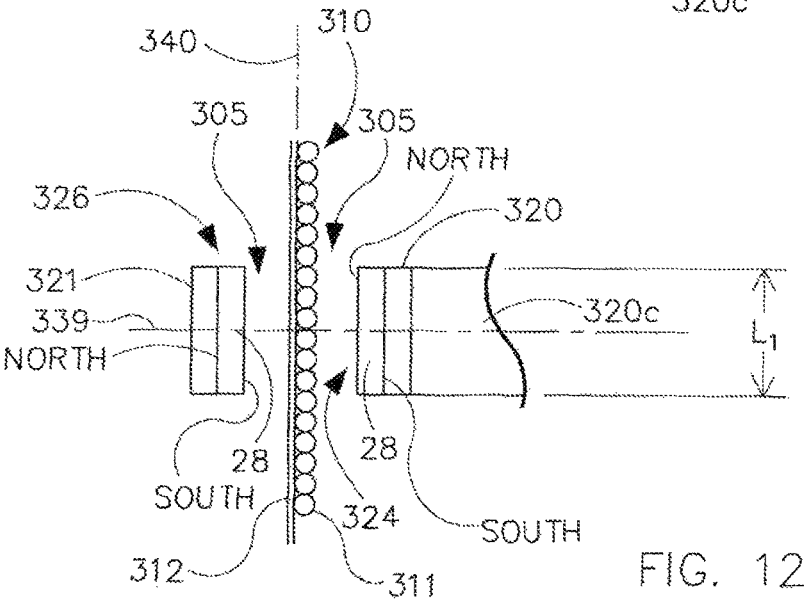
FIG. 12C

SPEAKER DRIVER

CROSS-REFERENCE TO RELATED APPLICATIONS

Continuation of application Ser. No. 13/843,893, filed on Mar. 15, 2013

BACKGROUND OF THE DISCLOSURE

1. Field of the Disclosure

The disclosure relates to speaker drivers and more particularly, to a speaker driver with a symmetrical motor assembly, a symmetrical voice coil support system and an open coil frame design.

2. Background of the Disclosure

Speaker drivers generally comprise a basket, a motor assembly, a voice coil and a moving assembly. The basket attaches to the motor assembly and supports the moving assembly. In a pancake style, axially aligned speaker driver, the motor assembly includes a bottom plate supporting a pole piece about which the permanent magnet is concentrically disposed. The top plate, bottom plate and pole piece are typically made of ferromagnetic material, which is not permanently magnetized. A magnetic gap is formed between the pole piece and the top plate.

The voice coil typically includes a concentrically wound wire around a bobbin known as a former. The voice coil is concentrically hung from its upper end within the magnetic gap of the driver by a moving assembly. When electrical signals from an amplifier pass through the voice coil, it turns into an electromagnet. As the current oscillates, the voice coil moves inwardly and outwardly, pushing the moving assembly. The moving assembly typically includes a surround, a spider and a cone. The surround and spider support and center the cone within the magnetic gap as the cone pushes and pulls air, transforming the electrical signal into sound.

An object of a speaker driver is to transform signals received from an amplifier into sound as accurately as possible. Linear response is one key to accomplishing this goal. FIG. 8 illustrates a prior art speaker driver 101 having a basket 102 with arms 106 cone 118 upper surround 114, spider 116, dust cap 108, voice coil 110, and motor assembly 104. One major source of non-linearity is a speaker driver's motor assembly. FIG. 8 illustrates a motor assembly 104 that includes one permanent magnet 125 and the three ferromagnetic pieces: the top plate 124, the back plate 126 and pole plate 127. For purposes of this disclosure, ferromagnetic materials will refer to those which generate a magnetic field when an external magnetic field is applied but do not become permanently magnetized. Ferromagnetic materials are used in speaker drivers as an inexpensive means to increase the strength of the motor assembly. In FIG. 8, the permanent magnet 125 is axially aligned along the long axis 140 with the north pole towards the basket 102 and the south pole towards the bottom plate 127. The ferromagnetic top plate 124 takes on a south polarity and the ferromagnetic back plate 126 takes on a north polarity in response to permanent magnet 125.

There are three sources of magnetic flux in magnetic gap 105 when the speaker driver is operating 1) static flux from the permanent magnet 125, 2) flux generated by the voice coil 110, when operating; and 3) flux generated by the ferromagnetic material in the plates 124, 125 and pole plate 127 in response to the permanent magnet 125 and voice coil 110 when operating. FIG. 8A illustrates a voice coil 110 in the inward excursion such that part of the voice coil winding 111 has moved below the magnetic gap 105. FIG. 8B illustrates a voice coil in the outward excursion wherein part of the voice coil winding 111 has moved above the magnetic gap 105. Loss of winding area 111 from the magnetic gap 105 results in a loss of linear response. Overhung voice coil designs may be used to allow a larger amount of travel or excursion without changing the amount of winding in the magnetic gap. However, asymmetries in motor designs still result in non-linearities.

The lack of symmetry in the motor assembly 104 geometry and use of different materials produces non-linear static flux across the magnetic gap and near vicinity. Typical speaker drivers, as illustrated in FIG. 8, have motor assembly geometries with a permanent magnetic material 125 and ferromagnetic material below the magnetic gap 126, 127. This geometry results in an increase in motor strength below the magnetic gap and an increase in electrical inductance below the magnetic gap, which creates non-linearities. In operation, the voice coil reverses polarity as it oscillates when excited by the alternating current affecting dipoles in the ferromagnetic pieces (124, 126 and 127), which may attempt to re-align. The permeability of the ferromagnetic plates is also affected by the flux generated by the voice coil resulting in non-linearites in the motor assembly. Eddy currents within the ferromagnetic materials may also result in loss of symmetry of the magnetic flux. Thus, there remains a need for a magnetically symmetrical motor assembly to reduce non-linearities as sources of distortion. Patent Publication No. US2014/0270323 and this application disclose novel designs with a substantially magnetically symmetrical motor using radially polarized magnetic systems of the same composition and geometry on both sides of the magnetic gap.

FIG. 8 illustrates a voice coil 110 concentrically disposed within motor assembly 104. During operation of the speaker driver 101, heat builds up in the voice coil 110 causing power-handling issues, especially for low frequency drivers like subwoofers. Three heat transfer mechanisms may be utilized for cooling: convection, conduction and radiation. Because the voice coil is suspended in air, and air a good insulator, the primary mode of heat dissipation for the voice coil is radiation. Most of the heat dissipated from the voice coil 110 via radiation is absorbed into the sidewall areas of the motor assembly 124*s*, 125*s*, 126*s* and 127*s*. Because most of the heat remains trapped near the voice coil 110, the voice coil 110 continues to heat up. As the voice coil temperature increases, its resistance rises and the impedance of the speaker increases making it less efficient. More power is needed to maintain the same sound power level, producing more heat.

Attempts to combat this vicious cycle can include use of pole vents 135. The pole vent 135 removes heat by convection using the air pumped by the dust cap 108. Unfortunately, the sidewalls of the plates obstruct the air being pumped through the magnetic gap 105. Most of the airflow pumped by the dust cap flows directly out the pole vent rather than sweeping through the magnetic gap to convection cool the coil. Likewise, the spider 116, dust cap 108 and magnetic gap 105 restrict air pumped by the cone 118, which flows between arms 106 of the basket 102 without cooling the voice coil 110.

Some designs use heat sinks to augment cooling. Aluminum heat sinks may be used to conduct absorbed heat away from the motor assembly sidewalls. Unfortunately, conduction cooling is less efficient than convection. Additionally, the heat sinks add weight to the driver, particularly detrimental to woofers and subwoofers, which are generally heavy. Thus, there remains a need in the art for a speaker driver, which minimizes the heat retained in the voice coil area. Patent Publication No. US2014/0270323 and this application disclose a novel open coil frame, which exposes most of the voice coil to free air. Such design minimizes heat trapped near the voice coil. The design also improves convection cooling, dramatically. The open coil frame design also exposes the coil to increase radiation heat loss.

Another source of nonlinearity in a speaker driver is the moving assembly. For purposes of this disclosure, the coil support system includes suspension members like half roll and progressive surrounds and spiders, but not the cone. FIG. 8 illustrates a typical surround 114 used to support a cone 118. As known in the art, suspension compliance changes relative to voice coil position and the differences between downward and upward excursion. The difference from downward and upward excursion may be attributed to the inner edge of the suspension having a smaller diameter D114*a* than outer edge of the suspension diameter D114*b* as illustrated in FIG. 14. Thus, the annular surface area on the along the outer half of the suspension is larger than the annular surface area on the inner half of the suspension making the cone move more easily on the downward excursion in comparison to the upward excursion. Similar behavior is exhibited by corrugated suspension members, such as a spider, which has successively smaller diameters as defined by each peak and valley of its sinusoidal shape moving inward the long axis 140. This phenomenon has been studied extensively by those in the art, most particularly by Dr. Wolfgang Klippel. Patent Publication No. US2014/0270323 and this application disclose designs that improve the linearity of the moving assembly.

SUMMARY OF THE DISCLOSURE

The present disclosure provides a speaker driver comprising a motor assembly wherein the motor assembly may be substantially magnetically symmetrical about a radial axis and a long axis. The present disclosure also provides a speaker driver comprising a voice coil with an upper end and a lower end wherein the voice coil may be supported at its upper and lower ends respectively above and below the motor assembly. In a preferred embodiment, the speaker driver may have a motor assembly and a voice coil support system that may be symmetrical about their coincident long and radial axes. Another preferred embodiment disclosure provides an open voice coil frame, which exposes the voice coil to open air.

One aspect of the disclosure provides a speaker driver comprising a frame with motor assembly disposed within the frame. A voice coil may be disposed moveably within a magnetic gap formed within the motor assembly. The voice coil, in one aspect of this disclosure, may be supported from both its lower and upper ends. An upper suspension may be adhered to the outer periphery of the voice coil and the frame above the motor assembly. A lower suspension may be adhered to the outer periphery of the voice coil and the frame below the motor assembly and a cone may be adhered to the voice coil above the motor assembly such that the only support of the cone is the voice coil support system. In another aspect of this disclosure, the motor assembly may be substantially symmetrical about a radial axis. In another aspect of this disclosure, a voice coil support system may comprise upper and lower suspension members, which are substantially symmetrical about the long axis of the speaker driver. Further still, the speaker driver may comprise a motor assembly and a voice coil support system that may be symmetrical about the radial and long axes of the speaker driver. In a preferred embodiment, the voice coil support system and motor assembly may be symmetrical about the radial and long axis of the motor assembly. The speaker driver frame may be made of metal or composite. Preferably, the speaker driver frame may be non-ferromagnetic. More preferably, the speaker driver frame may be aluminum.

The present disclosure, in another aspect, presents a speaker driver having a voice coil with a diameter larger than that of the speaker driver's cone, known in the art as an outside coil. In one embodiment, the winding of the voice coil may be in the inner periphery of the former. This embodiment of the voice coil is known in the art as an inside voice coil. In another embodiment, the winding may be in the inner periphery of the former and on the outer periphery of the former. This embodiment of the voice coil is known in the art as an inside/outside voice coil. Typically, voice coils consist of a single layer of wire on the former; however, multiple layers may be used on the inside, outside or both peripheries of the former. Wire used for the windings may be round or flat. Edge wound voice coils may also be used. However, a voice coil having a large gap between the windings, e.g., split gap voice coil, is not preferred. Voice coils with large gaps between windings may be known in the art as split gap voice coils or multiple gap voice coils, e.g., dual voice coils. The windings in such split gap voice coils may be wound in the same direction about the former or in different directions, e.g., one winding being wound in the clockwise direction and a second winding being wound in a counterclockwise. In preferred embodiments, the diameter of the voice coil may be from about ninety percent to about one hundred and ten percent of the diameter of the cone. In another preferred embodiment, the diameter of the voice coil is larger than the diameter of the cone. In other aspects, the voice coil may be underhung, wherein the length of the winding is from about ten percent to about ninety-nine percent or evenhung wherein the length of the winding is substantially one hundred percent. The voice coil may preferably be overhung, wherein the length of the winding is greater than the length of the magnetic gap, preferably from about 200 hundred percent to 2000 percent.

The speaker driver disclosed herein may employ a voice coil having a long length in relationship to the length of the former and the length of the speaker driver long axis. In one embodiment, the speaker driver comprises a voice coil winding from about twenty percent to about ninety percent the length of the former. In another embodiment, the voice coil comprises a winding wherein the length of the winding may be from about thirty percent to about eighty percent of the length of the speaker driver along its long axis. Preferably, the winding length may be from about fifty percent to about seventy percent of former length and the former length may be from about forty percent to about sixty percent of the speaker driver length. Naturally, the speaker driver of this disclosure may employ any combination of these length ratios.

Another aspect disclosed may be a voice coil support system having at least two suspension members wherein at least one suspension member may be adhered to the speaker driver frame above the motor assembly and at least one suspension member may be adhered to the speaker driver frame below the motor assembly. In one preferred aspect, the upper and lower suspension members have arcuate shapes.

More preferably, the upper suspension and lower suspension members have opposing arcuate shapes, which, in a further aspect, may be substantially symmetrical about the radial axis. The suspension members may have a variety of shapes, such as half rolls, progressive rolls and corrugated shapes, which may be, in another aspect, arranged in an opposing manner about the radial axis of the speaker driver. For example, the crown of an arch in a half roll upper suspension member may be arranged upward and the crown of an arch in a half roll lower suspension member may be arranged downward and vice versa. Similarly, upper and lower suspension members having corrugated or sinusoidal shapes may be arranged such that the crowns of successive arches of the upper suspension members are arranged in an opposing manner to the lower suspension member like mirror images about the radial axis. Regardless of the number of suspension members used in the disclosed speaker driver, it is preferable to have sets of paired suspension members, i.e., each set including two suspension members having substantially similar shapes; arranged substantially symmetrically about the radial axis and long axis of the speaker driver like mirror images. More preferably, only two suspension members are used for the voice coil support system. The voice coil support system may also be the sole support for a cone used in the speaker driver. The two suspension members are preferably of the same shape, same size and same material. The two suspension members are adhered as mirror images at distal ends of the former, one above the motor and one below the motor, each being at the same distance from the radial axis of the motor assembly.

Another embodiment disclosed is a speaker driver comprising a frame, having an upper end and a lower end; a motor assembly disposed within the frame; and a voice coil, comprising a winding on the outer periphery of a former. The voice coil may be disposed for axial movement within a magnetic gap concentrically formed within the motor assembly. The former, having an upper end, a lower end, an inner periphery and an outer periphery; may be adhered to the upper suspension's inner edge along the outer periphery of the former at the former's upper end. The upper suspension's outer edge may be adhered to the upper end of the frame above the motor assembly. A cone may be adhered to the former at the upper end of the former. The lower suspension's inner edge may be adhered to the outer periphery of the former at the lower end of the former, while the lower suspension's outer edge may be adhered to the lower end of the frame below the motor assembly.

The present disclosure, in one aspect, provides a voice coil support system for use in a speaker driver comprising an upper suspension and a lower suspension opposingly adhered to opposing ends of the voice coil. Preferably, the opposingly adhered upper and lower suspension members have opposing symmetrical shapes. More preferably, at least two suspension members are adhered to opposing ends of the voice coil wherein the voice coil support system may be substantially symmetrical about its long and radial axes. The voice coil support system may be further configured to adhere to the speaker driver frame in a manner, which may be symmetrical about the long axis of the speaker driver. In another preferable embodiment, the voice coil support system comprises an upper suspension, a lower suspension and a former, the former having an upper end, a lower end and an outer periphery wherein the upper suspension may be adhered to the outer periphery of the former at the upper end of the former and the lower suspension may be adhered to the outer periphery of the former at the lower end of the former wherein the voice coil support system may be substantially symmetrical about its long axis and radial axis.

In a preferred embodiment, a voice coil support system for a speaker driver comprises a former having an upper end, a lower end and an outer periphery; an upper suspension having an inner edge and an outer edge wherein the inner edge of the upper suspension may be adhered to the outer periphery of the former at the upper end of the former and the outer edge of the upper suspension may be adapted for adhesion to the upper end of a frame above a motor assembly; a lower suspension having an inner edge and an outer edge wherein the inner edge of the lower suspension may be adhered to the outer periphery of the former towards the a lower end of the former and the outer edge of the lower suspension may be adapted for adhesion to a lower end of a frame below the motor assembly.

In yet another preferred embodiment of the voice coil support, paired suspension members having the same shape and size and which are made of the same material may be adhered as mirror images to the speaker driver frame. In a preferred aspect of this embodiment the upper suspension of the paired suspension members may be adhered to the frame and voice coil former above a speaker driver motor assembly and the lower suspension may be adhered to the frame and voice coil former below the speaker driver motor assembly, wherein the upper suspension and lower suspension may be adhered at the same distance from a radial axis bisecting the center of the voice coil former. Another preferred aspect of the voice coil support systems may only use two suspension members in the speaker driver.

An essential aspect of the voice coil support system may be to support the speaker driver cone using only even numbered suspension members, e.g. two, four, six, etc.; not an odd number of suspension members, e.g., one, three, five, etc; regardless of whether the suspension members are surrounds, e.g., spiders, half rolls, progressive rolls and the like. Each pair of suspension members may be of the same shape, size and material and may be mounted on opposite sides of the motor assembly as mirrored images, equally spaced apart about the radial axis at distal ends of the former. In another aspect, the voice coil support system supports the voice coil and the cone.

This disclosure presents a symmetrical motor assembly. The motor assembly preferably comprises annular rings made from a plurality of radially polarized arc magnets. In one aspect, the motor assembly for a speaker driver may also comprise annular rings, which in one embodiment are non-ferromagnetic, preferably, concentric annular rings. One-piece annular permanent magnets may also be used for either the first or second magnet system or both. The magnets are made of neodymium, iron or boron. More preferably, the permanent magnets, which may be used, are known in the art as "neo" magnets. In one embodiment a motor assembly may comprise a first magnet system fixed, preferably by adhesive, in an annular ring forming an inner diameter and an outer diameter; a second magnet system fixed in an annular ring forming an inner diameter and an outer diameter wherein the outer diameter of the second magnet system is smaller than the inner diameter of the first magnet system and a magnetic gap formed between the inner diameter of the first magnet system and the outer diameter of the second magnet system whereby the first magnet system and the second magnet system are operatively coupled by magnetic flux wherein at least one magnetic system comprises a plurality of radially polarized arc magnets. In a preferred embodiment, the motor assembly comprises a first magnet system comprising a plurality of radially polarized arc shaped permanent magnets fixed in an annular ring, may form an inner diameter and an outer diameter. A second magnet system may also comprise a plurality of radially polarized arc shaped permanent magnets fixed in an annular ring forming an inner diameter and an outer diameter. In further aspects, the size of the magnetic systems disclosed may comprise a second magnet system with an outer diameter that is smaller than the inner diameter of the first magnet system. A magnetic gap may be formed between the inner diameter of the first magnet system and the outer diameter of the second magnet system whereby the first and second magnet systems are operatively coupled by a magnetic flux.

In another preferred embodiment of the motor assembly, the first and second magnet systems may have substantially the same composition on each side of the magnetic gap to promote symmetry of the static flux. In yet another embodiment, the length of permanent magnets fixed in the first and second magnet systems may be substantially the same on each side of the magnetic gap promoting symmetry of the static flux. In a preferred embodiment, the length of the first and second magnet systems are substantially equal to the length of the magnetic gap. Provided no ferromagnetic materials are made a part of the first and second magnetic systems, the length of the permanent magnet material is substantially equal to the length of the magnetic gap on both sides of the gap. In aspects, the magnet systems may comprise radially polarized arc magnets forming the annular ring may have from about one to about forty-five degrees of arc. Preferably, the first and second magnetic systems each comprise 36 arc magnets of ten degrees of arc. In one embodiment, the arc magnets may have shoulder portions for magnetically joining adjacent arc magnets. The magnetically joined adjacent arc magnets may form annular rings of various sizes. In another preferred embodiment, the arc magnets may have at least one protruding area and at least one recessed area for magnetically interlocking the plurality of arc magnets.

In a preferred embodiment, the motor assembly may be symmetrical about its long and radial axis. In another preferred aspect, the motor assembly may be symmetrically arranged within a speaker driver along its long axis. A preferred motor assembly embodiment of this disclosure may comprise a first magnet system comprising a plurality of radially polarized arc shaped permanent magnets fixed by adhesive to an outer non-ferromagnetic annular ring forming an inner diameter and an outer diameter and a second magnet system comprising a plurality of radially polarized arc shaped permanent magnets fixed by adhesive to an inner non-ferromagnetic annular ring forming an inner diameter and an outer diameter wherein said outer diameter of said second magnet system is smaller than said inner diameter of said first magnet system. Preferably, the first and second magnet systems are concentrically disposed within the speaker driver. A magnetic gap may be formed between said inner diameter of said first magnet system and said outer diameter of said second magnet system whereby said first magnet system and said second magnet system are operatively coupled by a magnetic flux.

In another preferred embodiment, the first and second magnet systems each use permanent magnetic material of the same composition and magnetic properties. Another preferred feature of the motor assembly may use first and second magnet systems of permanent magnetic material having substantially the same length as the magnetic gap. In yet another preferred embodiment, the motor assembly is magnetically symmetrical about its radial axis and long axis. For purposes of this disclosure, the long axis of the motor assembly runs parallel to the long axis of the speaker driver in which it may be installed and the radial axis cuts through both the first and second magnet systems along the centerline of the permanent magnetic material.

In a preferred embodiment, the first magnet system of the motor assembly may comprise a plurality of radially polarized arc shaped permanent magnets fixed by adhesive to a non-ferromagnetic annular ring. In a preferred embodiment, an outer ring may use a standoff plate to position the first magnet system a predetermined distance away from the voice coil. In one aspect, the non-ferromagnetic annular ring is shaped like a hoop with spokes extending from exterior of the hoop. In a preferable aspect, the spokes may act as one or more standoff plates for mounting and positioning the outer non-ferromagnetic annular ring. The outer non-ferromagnetic ring may be provided as part of the frame. In another preferred embodiment, the outer non-ferromagnetic annular ring and the inner non-ferromagnetic ring are concentrically disposed for providing symmetrical support about a long axis and radial axis of the motor assembly for the permanent magnetic material. In this aspect, the motor support may not interfere with the magnetic flux of the motor assembly. Standoff plates may also be used on the outer ring, the inner ring or both for positioning the rings at a predetermined distance from a voice coil, which may be disposed between the first and second magnetic systems.

This disclosure also provides a frame for a speaker driver comprising a plurality of j-beams. J-beams may be single piece, structural members characterized by having a shape similar to the letter "j," which may be best illustrated in FIG. 6E. In another embodiment, the j-beams may be integrally formed, e.g., by casting, injection molding or 3D printing, with other members of the frame and speaker driver, for example the top ring, a base ring, and an inner ring to facilitate manufacture and frame strength.

Each j-beam may have an upper end, a lower end, a shank area, a hook area and an optional recess. The recess may be formed within an inner periphery of the shank area near the lower end of the j-beam, before the bend of the j-shape. The lower end of the j-beam preferably has a base. The upper end of the j-beam on the hook area may be adapted for attaching an upper ring. Alternatively, the upper ring may be integrally formed with the j-beams. The upper ring may have an inner edge, an outer edge, a top surface and a bottom surface. In a preferable embodiment the upper ring may be adapted to for mounting the at least three j-beams substantially equidistant in a polygonal arrangement with the hook areas of the j-beams arranged inwardly of the outer edge of the upper ring. The frame may also have a lower ring with an inner edge and an outer edge. In a preferable embodiment, the outer edge of the lower ring may be held within the recesses of the at least three j-beams shank area. This disclosure also presents an embodiment with an outer ring having an inner edge and an outer edge. In a preferred embodiment, the outer edge of the outer ring may be attached to the inner periphery of the shank area of at least three j-beams. Preferably, the outer ring may be attached substantially equidistant from the upper ring and the lower ring. A preferred embodiment of the frame may also use an inner ring adapted for mounting on the upper end of the hook area of at least three j-beams. The inner ring may be preferably concentrically aligned with the outer ring.

In another embodiment, the frame may include j-beams, which are integrally formed with an upper ring. In yet another embodiment, combinations the j-beams and rings, may be formed integrally. In a preferable embodiment, the frame, including the j-beams, upper ring, lower ring, outer ring and inner ring may be molded or casted as one integral piece. In one preferred embodiment, the frame, including the j-beams, upper ring, lower ring, and inner ring may be molded or casted as one integral piece, excepting the outer ring. The inner ring may be preferably concentrically aligned with the outer ring about the same radial axis.

The present disclosure also presents a speaker driver comprising a frame having at least three j-beams. In a preferred embodiment, six j-beams may be used. Each j-beam may have an upper end, a lower end, a shank area, a hook area and a recess, the recess being formed within an inner periphery of the shank area near the lower end of the j-beam. In one embodiment, the lower end of the j-beam may preferably have a base. In another preferred embodiment, a base ring may connect the j-beam bases.

An upper edge on the shank area may provide a surface for attaching an upper ring. The upper ring may have an inner edge, an outer edge, a top surface and a bottom surface. The upper ring may be adapted for mounting the at least three j-beams substantially equidistant from each other in a polygonal arrangement. The hook areas of the j-beams may be arranged inwardly of the outer edge of the upper ring.

A lower ring having an inner edge and an outer edge may be held within the recess of the shank area of at least three j-beams by the outer edge of the lower ring, which may add rigidity to the frame and provide a surface for adhering a lower suspension. An outer ring having an inner edge and an outer edge, the outer edge of the outer ring may be attached to the inner periphery of the shank area of the j-beam, providing additional rigidity to the frame. Preferably, the outer ring may be located substantially equidistant between the upper ring and the lower ring. The inner edge of the outer ring may be adapted for mounting the first magnet system. An inner ring having an inner edge and an outer edge may be attached to the upper end of the hook area of the j-beam. The inner ring may be preferably aligned concentrically with the outer ring. The inner ring may be adapted for mounting a second magnet system on its outer edge.

The first magnet system, in aspects, may be attached to the inner edge of the outer ring. A second magnet system may be attached to the outer edge of the inner ring. A magnetic gap may be formed between the first magnet system and the second magnet system, wherein the first magnet system and second magnet system form a radially aligned motor assembly. A voice coil may be disposed moveably within the magnetic gap providing axial movement. The voice coil may comprise at least one winding wound over a former. The former, having an upper end, a lower end, an inner periphery and an outer periphery may be used to adhere an upper suspension. The upper suspension having an inner edge may be adhered to the outer periphery of the former at the upper end of the former. The outer edge of the suspension may be adhered to the inner edge of the upper ring above the motor assembly. A cone may be adhered to the inner periphery of the former at the upper end of the former. A lower suspension having an inner edge may be adhered to the outer periphery of the former at the lower end of the former. The outer edge of the lower suspension may be adhered to the inner edge of the lower ring below the motor assembly. In a further aspect, the speaker driver may have a first magnet system and second magnet system comprising a plurality of arc magnets.

An embodiment of a speaker driver may comprise a frame having a long axis and a radial axis comprising a plurality of elongate members with hook sections, said elongate members arranged about said radial axis held together by at least two rings wherein said elongate members and said rings define a plurality of spaced interconnected air gaps. In an aspect, a motor assembly may be disposed within the frame. The motor assembly may have a first magnet system polarized along the radial axis of the speaker driver. The first magnet system may comprise permanent magnetic material. Preferably, the speaker driver may comprise a second magnet system, polarized along the radial axis of the speaker driver, of permanent magnetic material. In a preferred aspect, the first and second magnet systems may be concentrically arranged to form a magnetic gap wherein the length of the first and second magnet systems are substantially equal to the length of the magnetic gap. Alternate embodiments of the motor assembly may comprise a first magnet system and a second magnet system of permanent magnetic material and non-ferromagnetic material, for example support rings, concentrically arranged wherein the first and second magnet systems are substantially equal to the length of the magnetic gap. The non-ferromagnetic support rings may be adapted to be fixed on a non-ferromagnetic frame.

In a preferred aspect, an overhung voice coil, comprising a winding and a former, may be disposed moveably within a magnetic gap formed within said motor assembly. In a preferred embodiment, the winding may be exposed to free air with the exception of the length of the magnetic gap. In aspects, the voice coil winding may not be surrounded or enveloped by ferromagnetic material, aluminum or non-ferromagnetic material on one or both sides of the voice coil. In another preferred aspect, the speaker driver may use a suspension system consisting of only two suspension members, a lower suspension member and an upper suspension member. The two suspension members may support both the voice coil and a cone wherein the lower suspension member is adhered to the frame and to the voice coil below the motor assembly and the upper suspension member may be adhered to the frame and to the voice coil and the cone above the motor assembly. In a preferred embodiment, aspect the voice coil support system may have only two suspension members, which may be disposed substantially equidistant from the motor assembly along the long axis of the speaker driver. In a preferred aspect, the two suspension members may be half roll surrounds, which may be mounted equidistant from the radial axis of the motor assembly in a mirror like fashion wherein the two suspension members may be the same shape, size and may be made of the same material, e.g., foam, santopene, polyester, Nomex®, and the like.

Another embodiment disclosed is a speaker driver comprising a frame and a motor assembly disposed within the frame. The motor assembly may comprise a first magnet system comprising a plurality of radially polarized arc shaped permanent magnets fixed by adhesive to a non-ferromagnetic annular ring forming an inner diameter and an out diameter; a second magnet system comprising a plurality of radially polarized arc shaped permanent magnets fixed by adhesive to a non-ferromagnetic annular ring forming an inner diameter and an outer diameter wherein said outer diameter of said second magnet system is smaller than said inner diameter of said first magnet system; a magnetic gap formed between said inner diameter of said first magnet system and said outer diameter of said second magnet system whereby said first magnet system and said second magnet system are operatively coupled by a magnetic flux.

Another embodiment of this disclosure is a speaker driver comprising a frame; a motor assembly disposed within the frame where the motor assembly may have a first magnet system polarized along the radial axis of the speaker driver, the first magnet system comprising permanent magnetic material and non-ferromagnetic material and a second magnet system polarized along the radial axis of the speaker driver, the second magnet system may comprise permanent magnetic material and non-ferromagnetic material. The first and second magnet systems may be concentrically arranged to form a magnetic gap wherein the length of the first and second magnet systems may be substantially equal to the length of the magnetic gap. In another aspect, the speaker driver may further comprise a winding and a former, which is disposed moveably within a magnetic gap formed within the motor assembly. In a preferred aspect, a voice coil support system may consist of two suspensions. An upper suspension member may be adhered to said frame and said former above said motor assembly for supporting said voice coil. A lower suspension may be adhered to said frame and to said former below said motor assembly for supporting said voice coil. The voice coil support system may support a cone by adhering the cone to the upper suspension. In a preferred embodiment, only two suspension members are used to support the voice coil and the cone.

A preferred embodiment of the speaker driver may use a frame, which is characterized by an open structure exposing the voice coil. In preferred aspects, the speaker driver may be characterized by an open coil frame design having an absence of material proximate said voice coil such that over about 50% of the winding area of the coil is exposed for cooling to free air. In another aspect, from about 50% to about 95% of said winding area is exposed. A preferred embodiment of a speaker frame may be characterized by an open structure configured to expose an inner surface of a voice coil and an outer surface of the voice coil used in operation within a magnetic gap of a speaker driver. An embodiment using a frame having an open voice coil may expose inner and outer surfaces of the voice coil to promote cooling of the voice coil and improve speaker efficiency. In preferred embodiments of the open voice coil frame, the outer surface of the voice coil winding, the inner surface of the voice coil winding or both are exposed except for the length of the magnetic gap.

A preferred embodiment of a speaker driver may comprise a frame, which may comprise a plurality of spaced apart j-beams disposed for providing air gaps between the j-beams. The air gaps preferably extend from the upper end of the frame to the lower end of the frame and through the bend area exterior to a voice coil movably disposed within the frame. In another preferred aspect, the spaced apart plurality of j-beams are disposed for providing a plurality of air gaps between hook areas of the j-beams interior to the voice coil. The air gaps exterior to the voice coil may expose the voice coil to free air and may minimize heat build up around the voice coil. The exposed voice coil may be convection cooled by air pumped by the surrounds exterior to the voice coil. The exposed voice coil may also be convection cooled by air pumped by the cone interior to the voice coil.

Another embodiment of a frame for a speaker driver may be formed by a plurality of j-beams, the j-beams having an upper end, a lower end, a shank area, a recess, a base and a hook area wherein the j-beams are connected by at least two rings proximate the upper end and the lower end of the j-beams defining a plurality of interconnected air gaps. Interconnected air gaps may surround the adjacent j-beam shank areas, bend areas, base areas and hook areas. The interconnected air gaps may also be interconnected from the exterior of the voice coil and the interior of the voice coil. In a preferred aspect, the interconnect air gaps extend the length of the frame from proximate said upper end to proximate said lower end of the frame. In another preferred aspect, the frame may have a ring held within recesses, wherein the recesses are formed within an inner periphery of the shank areas of the j-beams. In another preferred embodiment, the frame may have j-beams with integral hook areas formed at the base of the j-beams. In a preferred embodiment, two j-beams merge at the base of the j-beam and form a single, integral hook area. In a preferred aspect of this preferred embodiment, pairs of eight j-beams merge to form four j-beam hook areas.

Notation and Nomenclature

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

The following discussion and in the claims, the terms "including" and "comprising" are used in an open-ended fashion, and thus should be interpreted to mean "including, but not limited to . . . ".

Singular or plural number(s) may also include the plural or singular number respectively.

The word "or" in reference to a list of two or more items, that word covers all of the following interpretations of the word: any of the items in the list, all of the items in the list, and any combination of the items in the list.

The word "ferromagnetic" means material which generate a magnetic field when an external magnetic field is applied but do not become permanently magnetized.

The word "non-ferromagnetic" means material other than a permanent magnet or a ferromagnetic material.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, not drawn to scale, in which like reference characters designate like or similar elements throughout the several figures of the drawing and wherein:

FIG. 1 is a cross-sectional view of one embodiment of a speaker driver of this disclosure.

FIG. 1A is a cross-sectional view of an embodiment of a speaker driver of this disclosure using a multiple roll suspension.

FIG. 1B is a detail of FIG. 1 expanded to illustrate the voice coil placement, including its winding and former, within the magnetic gap formed within the first and magnet systems of the motor assembly and polarities of the radial magnet.

FIG. 4 is a cross-sectional side view of a motor assembly of this disclosure.

FIG. 4A is an expanded view of a portion of an embodiment of a motor assembly illustrating the magnetic flux lines between the magnet systems of a motor assembly of this disclosure.

FIG. 4B is a cross-sectional top view of a motor assembly of this disclosure.

FIG. 8A is an expanded view of a portion of a prior art speaker illustrating inward excursion of the voice coil.

FIG. 8B is an expanded view of a portion of a prior art speaker illustrating outward excursion of the voice coil.

FIG. 10 is a perspective view of one embodiment of a speaker driver frame of this disclosure using an open coil design, which illustrates j-beams with integral hook areas.

FIG. 10A is a bottom view of one embodiment of a speaker driver frame of this disclosure using an open coil design, which illustrates j-beams with integral hook areas.

FIG. 10B is a top view of one embodiment of an outer ring with standoff plates.

FIG. 12B is a cross-sectional top view of a motor assembly of this disclosure.

FIG. 12C is a detail of one embodiment of a motor assembly in which the first and second magnet systems illustrated are supported by the outer and inner rings with disposed voice coil. The polarities of the radial permanent magnets are also illustrated.

DETAILED DESCRIPTION OF THE PREFERRED EMBODIMENTS

Figure 2:
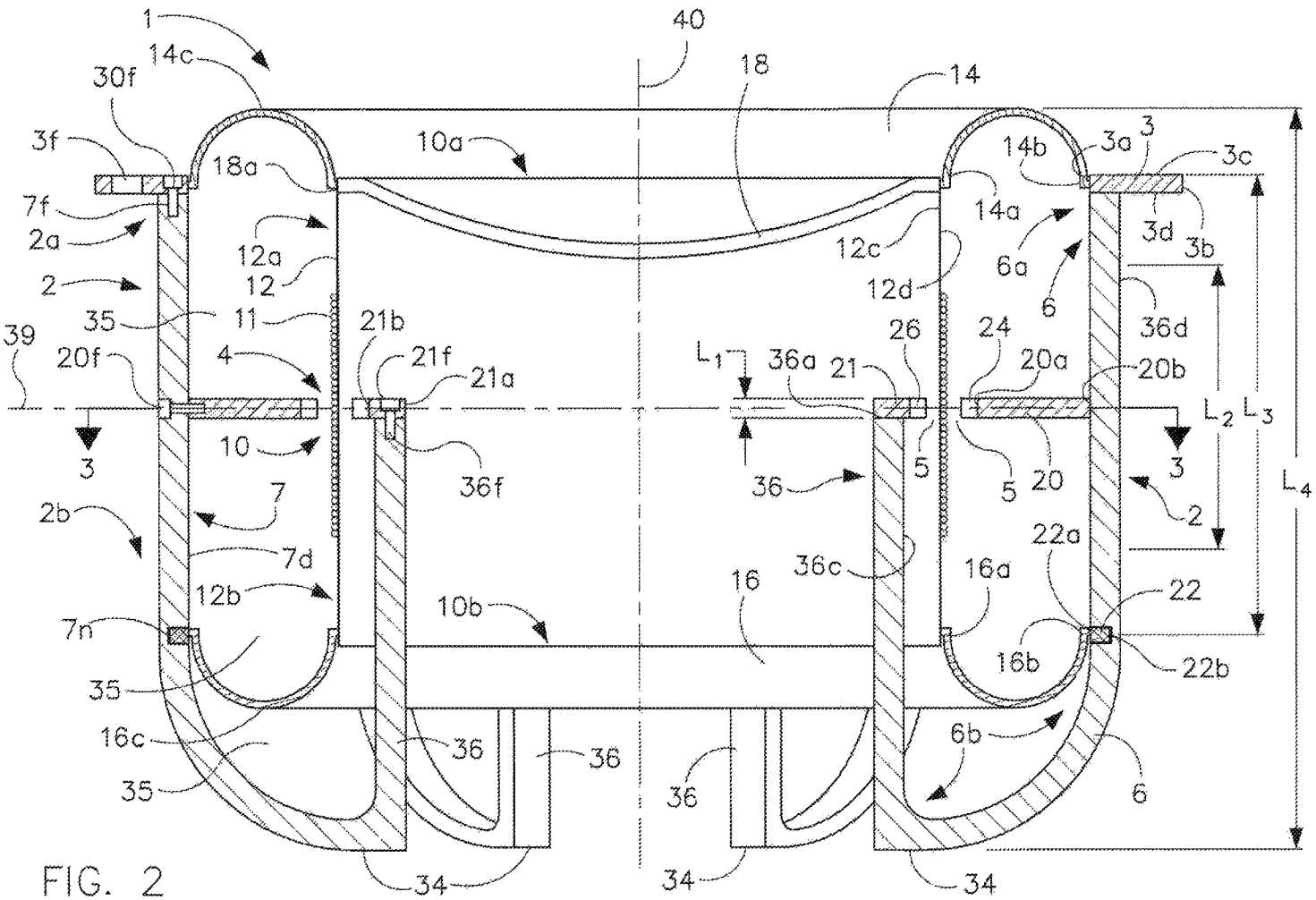
FIG. 2 is a cross-area view of another embodiment of a speaker driver of this disclosure illustrating use of fasteners on the left side of the long axis and adhesive attachment on the right.

The present disclosure in broad aspects, relates to a speaker driver. In other aspects, it relates to a motor assembly, a voice coil support system and a frame, which may be used in the driver. The present disclosure is susceptible to embodiments of different forms. There are shown in the drawings, which will be described herein in detail, specific embodiments of the present disclosure with the understanding that the present disclosure is to be considered an exemplification of the principles of the disclosure and is not intended to limit the disclosure to that illustrated and described herein. The use of "upper," "lower," "inner," "outer," "top," "bottom," "inside," "outside," "inward," "upward" and the like refer to the orientation of the speaker driver as it appears in the Figures. Further, while embodiments may be described as having one or more features or a combination of two or more features, such a feature or a combination of features should not be construed as essential unless expressly stated as essential.

Referring now to the drawings, two alternative embodiments of the speaker driver 1 are illustrated in FIG. 1 and FIG. 1A. FIG. 1 is a cross-sectional view of one embodiment of the disclosed speaker driver 1. The speaker driver 1 includes a frame 2; a motor assembly 4; a voice coil 10, an upper suspension 14, a lower suspension 16 and a cone 18. The concentrically disposed voice coil 10 is typically made by winding wire around a bobbin, known as the winding 11 and former 12, respectively. The winding comprising at least one wire wound about the former 12 leaves the upper end and lower ends 10*a*, 10*b* ends of the voice coil 10 bare for adhesion to the suspension members 14, 16 and the cone 18. In aspects, the voice coil 10 of embodiments of this disclosure may be inside coils (not shown), outside coils or inside outside voice coils (not shown). The motor assembly 4 comprises two annular magnet systems 24, 26 concentrically disposed within the frame 2. The voice coil 10 is shown substantially bisecting a magnetic gap 5 formed between the two magnet systems 24, 26.

Continuing, FIG. 1 illustrates another embodiment having an upper suspension 14 and lower suspension 16 adhered to the upper and lower ends of the frame 2*a*, 2*b* on opposite sides of the motor assembly 4. Suspension members typically used in the art are commonly called surrounds and spiders. Surrounds are generally made from a foam or butyl rubber. Surrounds may have be cupped, flat, corrugated or have progressive rolls. A preferred arcuate shape for a surround may be a half-roll, but more preferably progressive rolls. Spiders are typically corrugated and made from a stiffer material, preferably fabrics such as cotton, polypropylene or Nomex®. FIG. 1A illustrates an embodiment having corrugated suspension members. A preferred embodiment may use spiders of Nomex® having progressive rolls. Both suspension types have inner and outer circumferential edges for adhesion to the voice coil 10 and frame 2, respectively. As illustrated in FIG. 1 and FIG. 1A, the upper 14, 14' and lower suspension members 16, 16' of these embodiments may be respectively adhered between the voice coil 10 at the upper and lower ends 10*a*, 10*b* of the voice coil 10 and frame 2 on opposite sides of the motor assembly 4 allowing the voice coil 10 to move up and down the long axis 40. FIG. 1 and FIG. 1A also illustrate use of opposing suspension members 14, 16. The suspension members 14, 16 may have arcuate shapes, which mirror each other symmetrically about the long and radial axes 40, 39 of the speaker driver 1. In another embodiment, the upper suspension 14 may be adhered to the outer periphery 10*d* of the voice coil 10 and the frame 2 above the motor assembly 4. In a further aspect of this embodiment, the lower suspension 16 may be adhered to the outer periphery 10*d* of the voice coil 10 and the frame 2 below the assembly 4.

The motor assembly 4 illustrated in FIG. 1 comprises two permanent annular ring magnets systems disposed concentrically within the frame 2. The permanent annular ring magnets systems 24, 26 may be high-grade ferrite, strontium or AlNiCo alloys; however, neodymium is preferred. The first magnet system 24 may be disposed outside the second magnet system 26. An embodiment of the motor assembly 4 illustrated in FIG. 1 is symmetrical about the long axis 40 and radial axis 39 of the speaker driver 1. Unlike prior art speaker drivers, having magnetic return paths through magnetically conducting top plates, pole pieces and sidewalls, preferred embodiments of this disclosure may use materials which do not conduct magnetically. The result may be a substantially symmetrical magnetic flux within the magnetic gap as depicted in FIG. 4A. FIG. 1 also illustrates an embodiment of an overhung voice coil 10 wherein the amount of winding 11 above and below the motor assembly 4 about the long axis 40 of the driver 1 may be substantially equal. When electrically excited, the amount of winding within the magnetic flux may be substantially constant resulting in an electrically symmetrical motor assembly 4.

The cone 18 of the driver 1 may be circumferentially adhered to the inner periphery 10*c* of the voice coil 10 at the upper end 10*a* of the voice coil 10. Typical cone materials are paper, PMI (closed cell polymethacrylimide available from Evonik, HCL (HoneyCombLaminate), pearl mica, thermalum, aluminum and titanium coated polypropylene, PBO fiber, and various fabrics such as Nomex®, Kevlar® and Mylar® available from DuPont. When electrical signals from an amplifier (not shown) pass through the voice coil 10, it turns into an electromagnet. As the current in the voice coil 10 oscillates, its polarity reverses and the voice coil 10 is alternately attracted to and repealed by fixed poles of the first and second magnet systems 24, 26. The voice coil 10 thus moves up and down the long axis 40 of the speaker driver 1, pushing and pulling the cone 18, which pushes and pulls air, transforming the electrical signal into sound. FIG. 1B is a detail of the motor assembly 4 of FIG. 1 illustrating the pole orientation of the first and second magnet systems 24, 26.

Figure 3:
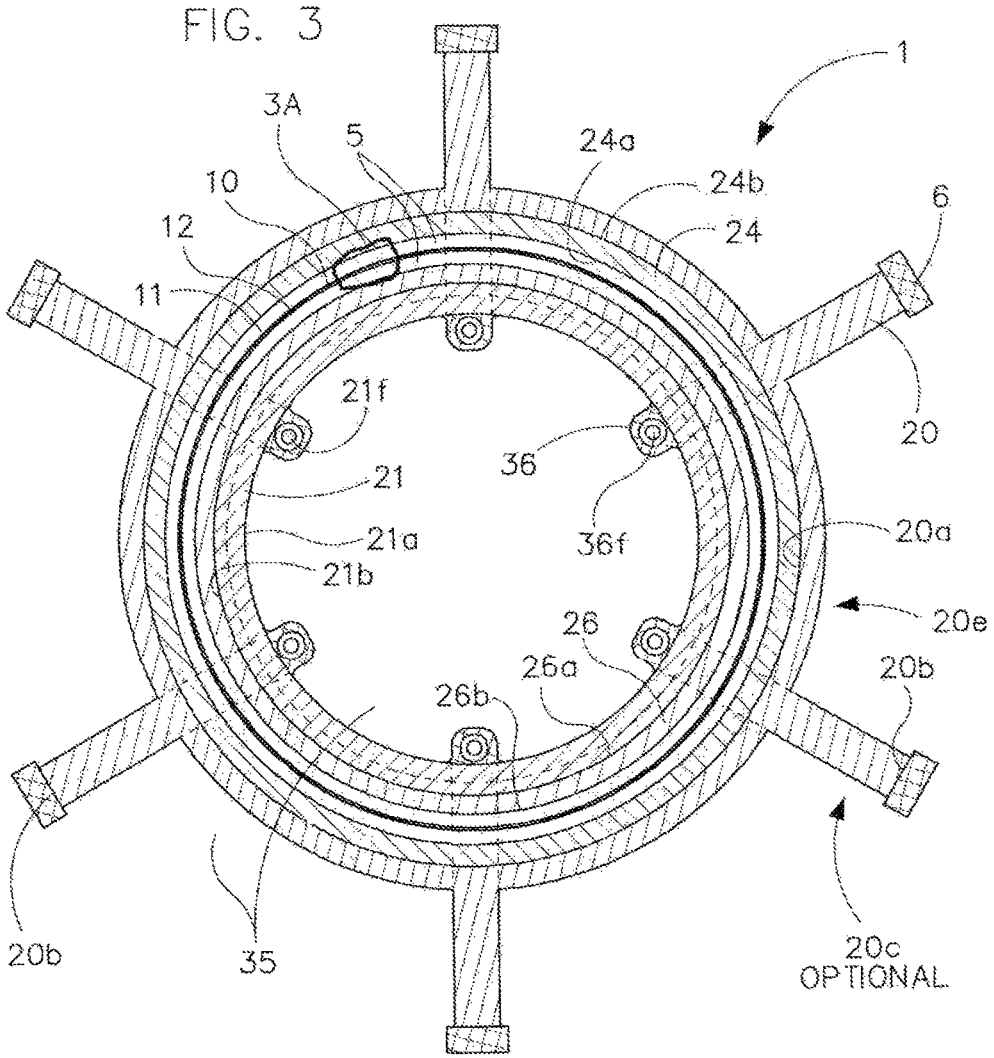
FIG. 3 is a cross-area view of FIG. 2 taken along line 3-3.
Figure 6E:
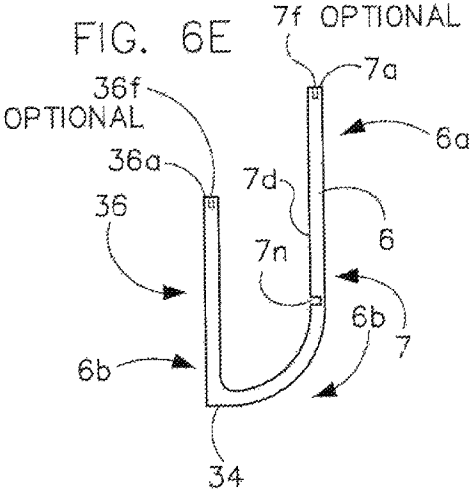
FIG. 6E is a cross-sectional side view of a j-beam of a frame embodiment of this disclosure.
Figure 6C:
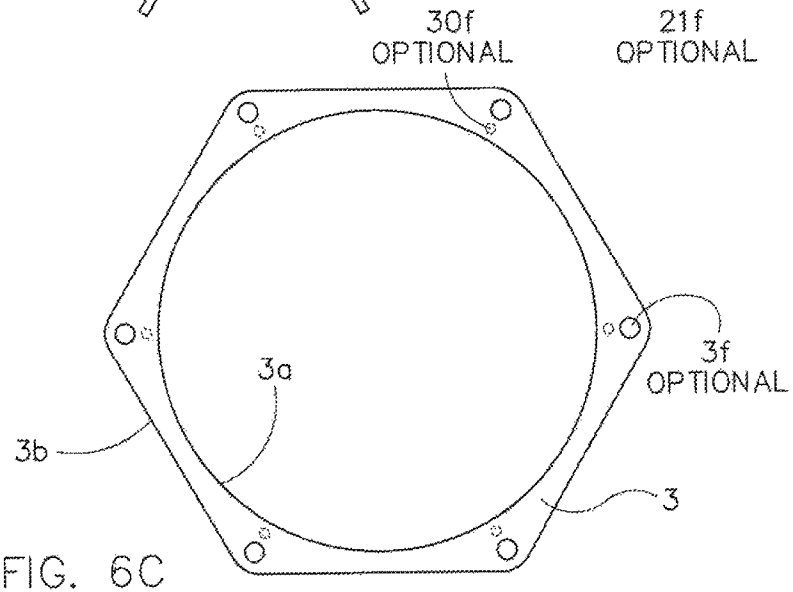
FIG. 6C is a cross-sectional top view of an upper ring of a frame embodiment of this disclosure.
Figure 7:
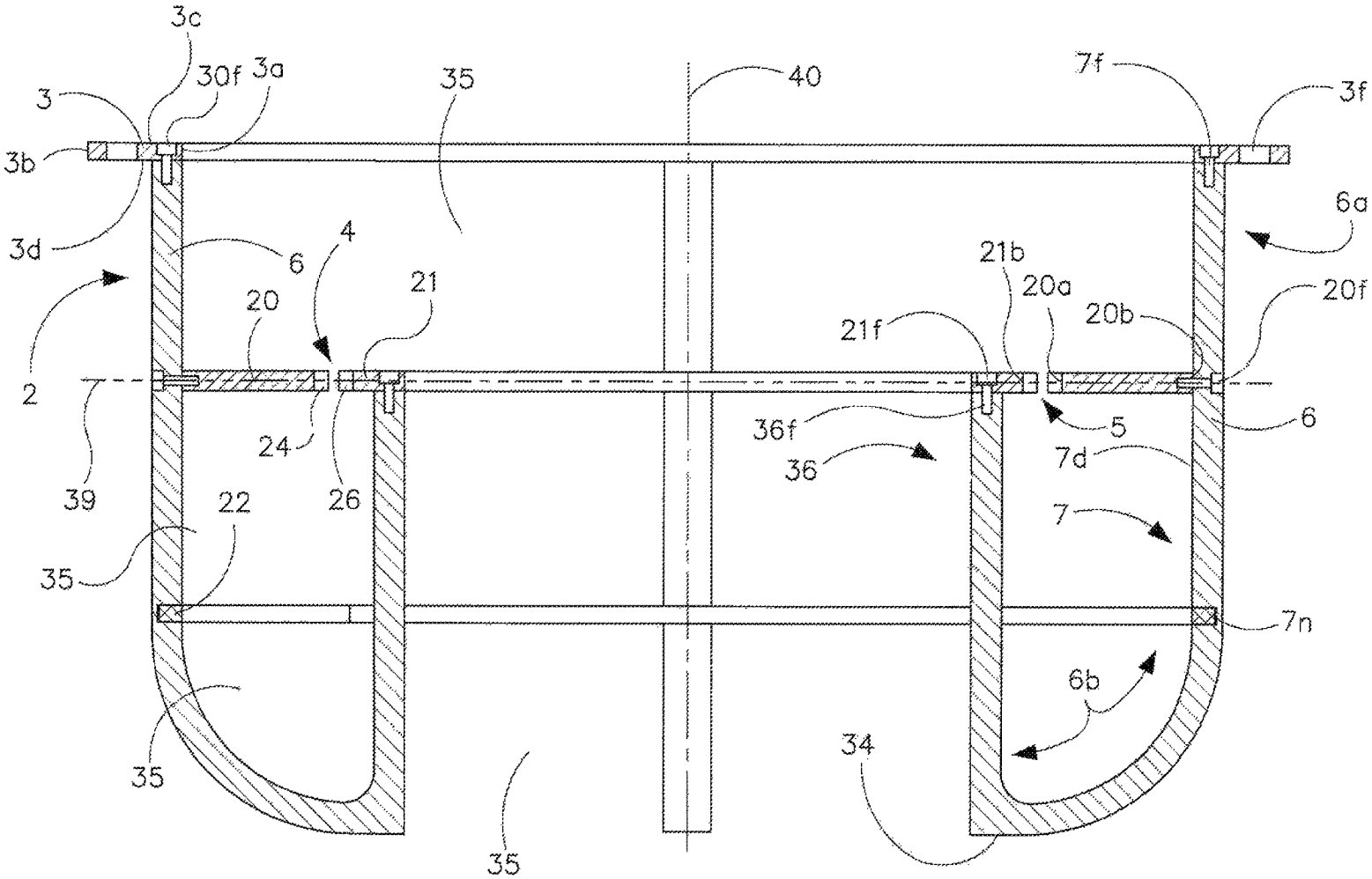
FIG. 7 is a cross-sectional view of an embodiment of an assembled frame of this disclosure using four j-beams.
Figure 8:
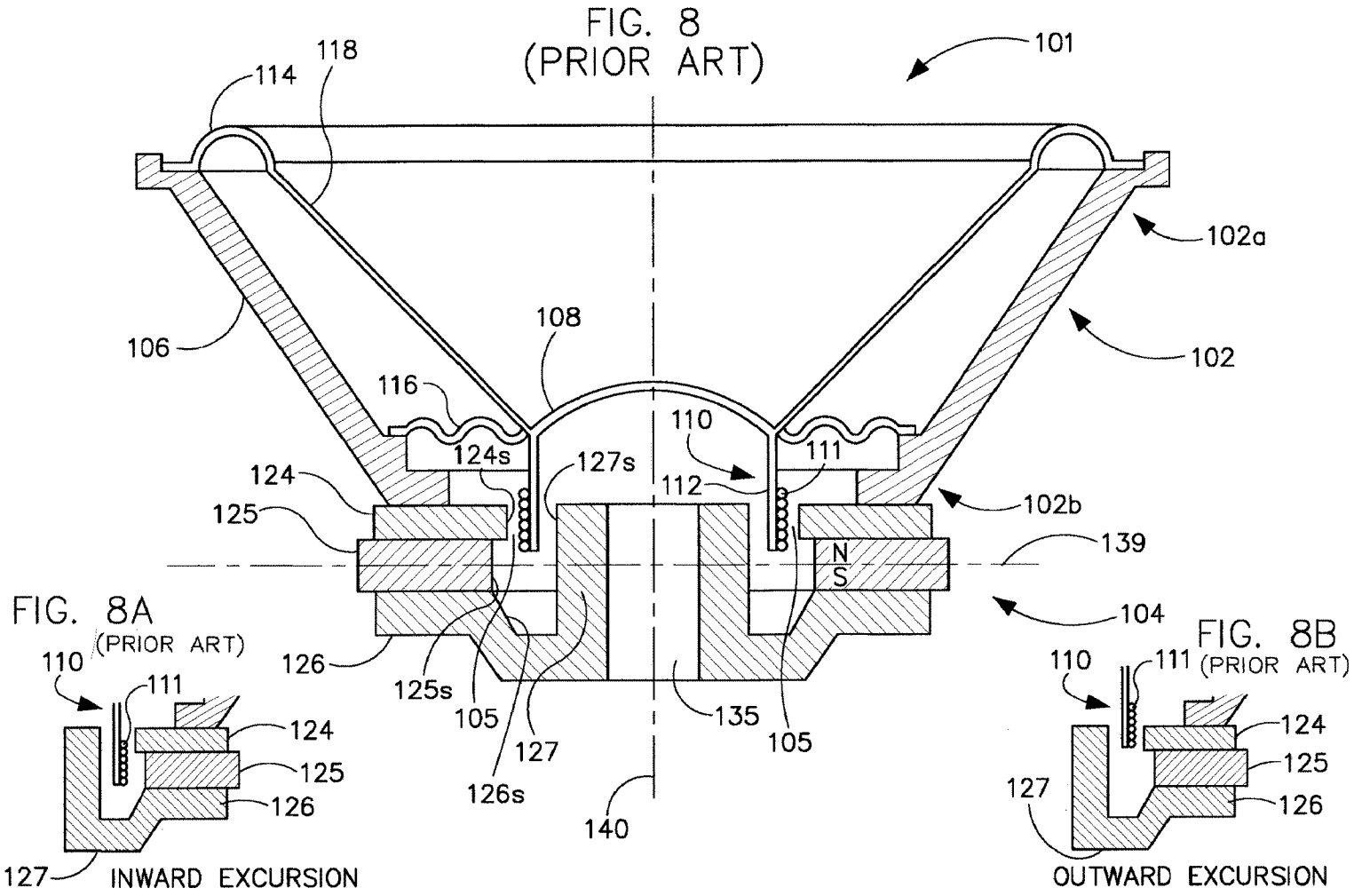
FIG. 8 (PRIOR ART)
FIG. 8 is a cross-sectional view of a prior art speaker driver.

Referring now to FIG. 2, a speaker driver 1 having a frame 2 comprising six j-beams 6 is illustrated. The j-beams, as depicted in FIG. 6E, may have a an upper end 6*a*, a lower end 6*b*, a shank area 7, a recess 7*n* within the j-beam inner periphery 7*d*, and a hook area 36. The lower end 6*b* of the j-beam 6 has a base 34 illustrated by the flattened area. Referring again to FIG. 2, the frame 2 may be assembled using at least four rings, an upper ring 3, a lower ring 22, an outer ring 20 and an inner ring 21. The j-beams 6 are aligned with the long axis and radially spaced apart from one another. Preferably, the j-beams are arranged equidistant from each other as seen in FIGS. 2-3 and 7. The spaced apart j-beams form large air gaps 35 in the frame 2 clearly depicted in FIGS. 2 and 7. The four rings may be attached to the j-beams 6 using means known in the art, e.g., fasteners, adhesive, welding and the like. FIG. 2 illustrates use of fasteners for rings 3, 20 and 21 left of the long axis 40 and adhesive on the right side of the long axis 40. Use of welding is not shown. FIG. 6*c* illustrates an upper ring 3 adapted for mounting six j-beams in a hexagonal arrangement. The perimeter of the outer edge 3*b* of the upper ring 3 may be shaped as desired for mounting the speaker driver 1 into a speaker cabinet (not shown) using fasteners through optional openings 3*f*.

The lower ring 22 may be used to secure the lower ends of the j-beams 6*b* as seen in FIG. 2. The hook areas 36 of the j-beam 6 may be preferably arranged interiorly from the outer edge (3*b*) and the inner edge (3*a*) of the upper ring 3 of the j-beam 6 before inserting the outer edge 22*b* of the lower ring 22 into the shank recess 7*n*. The lower ring 22 may be preferably attached by adhesive within the shank recess 7*n* for extra stability. The inner edge 22*a* edge of the lower ring 22 may be adapted for attaching the outer circumferential edge of the lower surround 16*b*, preferably using adhesive. The inner edge 22*a* of the lower ring 22 may protrude interiorly from the shank section 7 or the length of the inner ring 22 may be less than the length of the shank recess 7*n* to facilitate adhering the outer circumferential edge 16*b* of the lower suspension 16 to the inner edge 22*a* of the inner ring 22.

As illustrated in FIG. 2, the outer ring 20 may be used to attach the first magnet system 24. The first magnet system 24 may be preferably attached to the inner edge 20*a* of the outer ring 20. FIG. 6A is a cross-area view of the outer ring 20. The outer ring 20 may be annular shaped or may be a hoop and spoke design as illustrated. The outer edge of the hoop area 20*b* may be attached to the inner periphery 7*d* of the shank area 7 by adhesive or using fasteners. In an embodiment using a hoop and spoke design, the outer edge 20*b*' of the optional spoke area 20*c* may be attached to the inner periphery 7*d* of the shank area 7 by adhesive as illustrated on the right side of the long axis 40 in FIG. 2 or using fasteners as illustrated on the left side of the long axis 40 in FIG. 2. The optional spoke area may be used as a standoff plate for positioning the first magnet system along the radial axis 39. The outer ring 20 may be attached to the inner periphery 7*d* of the shank area 7 substantially midway between the upper ring 3 and the lower ring 22 along the long axis 40.

The inner ring 21 may be used to attach the second magnet system 26. The second magnet system 26 may be preferably attached to the outer edge 21*b* of the inner ring 21. The inner ring 21 may be mounted on the upper edge 36*a* of the hook area 36 of the j-beam 6. The inner ring 21 may be attached using adhesive or may be attached using fasteners as illustrated on the right and left side of the long axis 40 in FIG. 2.

Continuing with FIG. 2, the cone 18 may be adhered to the voice coil 10 at the upper end 12*a* of the former 12 on the inner periphery 12*c* of the former 12. An embodiment illustrated in FIG. 2 has a suspension system of two half roll surrounds supporting the upper end 10*a* and lower end 10*b* of the voice coil 10 by adhesion to the outer periphery 12*d* of the former 12 of the voice coil 10 at the upper end 12*a* of the former 12 and by adhesion to the outer periphery 12*d* of the former 12 of the voice coil 10 at the lower end 12*b* of the former 12. The upper suspension 14 depicted in FIG. 2 is a half roll. In this embodiment, the outer edge 14*b* of the upper suspension 14 may be adhered to the inner edge 3*a* of the upper ring 3 above the motor assembly 4. The inner edge 14*a* of the upper suspension 14 may be adhered to the upper end 12*a* of the former 12 of the voice coil 10 along the outer periphery 12*d* of the former 12 of the voice coil 10. The outer edge 16*b* of the lower suspension 16 may be adhered to the inner edge 22*a* of the lower ring 22 below the motor assembly 4. The inner edge 16*a* of the lower suspension 16 may be adhered to the lower end 10*b* of the voice coil 10 along the outer periphery 12*d* of the former 12 of the voice coil 10 at the lower end 12*b* of the former 12 of the voice coil 10. Thus, in aspects, the voice coil 10 of this embodiment may be supported by adhesion of at least two suspension members, at least one on its upper end 10*a* and at least one on its lower end 10*b*. In some embodiments upper and lower suspension members of may be of dissimilar shape (not shown). FIG. 2 illustrates an upper suspension 14 having a half roll substantially similar to the lower suspension 16. Preferably, the upper and lower suspension members 14, 16 are adhered to oppose each. More preferably, the upper suspension 14 and the lower suspension 16 are symmetrically opposed about their long and radial axes, like a mirror as illustrated in FIG. 2, with the upper suspension member crown 14*c* facing upward and the lower suspension member crown facing 16*c* downward.

The lengths of the magnet gap $L_1$, the winding $L_2$, the former $L_3$ and the speaker driver $L_4$ are illustrated in FIG. 2. The voice coil 10 of this illustrated embodiment is overhung, having a winding length $L_2$ longer than the magnetic gap length $L_1$. Although the speaker driver 1 of this disclosure may use an underhung voice coil 10, wherein the winding length $L_2$ is shorter than the magnetic gap length $L_1$ or an evenhung voice coil wherein the winding length $L_1$ is substantially equal to 100 percent of the magnet gap length $L_1$ using an overhung voice coil 10 may be preferred. The winding length $L_2$ may be at least twenty percent the length of the former $L_3$ and may be from about thirty percent to about eighty percent of the length of the speaker driver $L_4$. The winding length $L_2$ may be preferably configured to have the same amount of winding within the magnetic gap 5 corresponding to the maximum designed excursion of the cone 18.

Figure 3A:
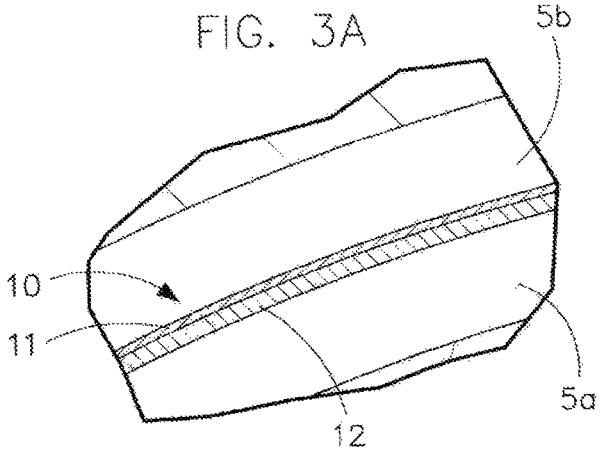
FIG. 3A is a detail of FIG. 3 expanded to illustrate the voice coil placement within the magnetic gap.

FIG. 3 is a cross-sectional top view of the speaker driver 1 embodiment in FIG. 2 taken along the section line 3-3. FIG. 3 illustrates the radial symmetry of the speaker driver 1. Reviewing the elements from the outermost to the innermost, one may see the j-beam 6; the outer edge 20*b* of the outer ring 20, the outer ring 20 (including the spoke area 20*c* and the hoop area 20*e*), the inner edge 20*a* of the outer ring 20; the outer edge 24*b* of the first magnet system 24, the first magnet system 24, the inner edge 24*a* of the first magnet system 24; an outer portion of the bisected magnetic gap 5*b*; the voice coil 10 (including the winding 11 and the former 12); the inner portion of the bisected magnetic gap 5*a*; the outer edge 26*b* of the second magnet system 26, the second magnet system 26, the inner edge 26*a* of the second magnet system 26, the outer edge 21*b* of the inner ring 21, the inner ring 21 and the inner edge 21*a* of the inner ring 21. FIG. 3A is an expanded view of the magnetic gap 5, substantially bisected by the voice coil 10 comprising the winding 11 and former 12 into magnetic gap portions 5*a* and 5*b*.

As shown in FIG. 4, one embodiment of a motor assembly 4 comprises a first magnet system 24 and a second magnet system 26. The second magnet system 26 may be concentrically aligned along radial axis 39 inside the first magnet system 24 such that the outer diameter of the second magnet system D26*b* is smaller than the inner diameter of the first magnet system D24*a*. Each magnet system may be made from a plurality of radially polarized arc magnets 28 fixed in an annular ring. The plurality of arc magnets 28 forming the first magnet system 24 may be attached to the inner edge 20*a* of the outer ring 20 (See FIG. 2.) or they may be attached to each other to form an annular ring before attachment to the inner edge 20*a* of the outer ring 20. Similarly, the plurality of arc magnets 28 forming the second magnet system 26 may be attached to the outer edge 21*b* of the inner ring 21 to form an annular ring or they may be attached to each other to form an annular ring before attachment to the outer edge of the inner ring 21*b*. The first magnet system 24 or the second magnet system 26 may be encapsulated in epoxy. The first and second magnet systems 24, 26 may preferably be aligned along the long axis 40. (See FIG. 2.)

Continuing with FIG. 4A depicts the magnetic pole arrangement for two of the plurality of arc magnets 28. In this embodiment, the poles are aligned such that a southern pole may be at the outer edge 24*b* of the first magnet system 24, a northern pole may be at the inner edge 24*a* of the first magnet system 24, a southern pole may be at the outer edge 26*b* of the second magnet system 26 and a northern pole may be located at the inner edge 26*a* of the second magnet system 26. In another embodiment, the poles may be reversed for each magnet system. The lines of magnetic flux coupling the two magnet systems are shown in FIG. 4A flowing symmetrically across the magnetic gap 5. A preferred embodiment of the motor assembly illustrated in FIG. 4, may be symmetrically aligned about both its long and radial axes.

Figure 5:
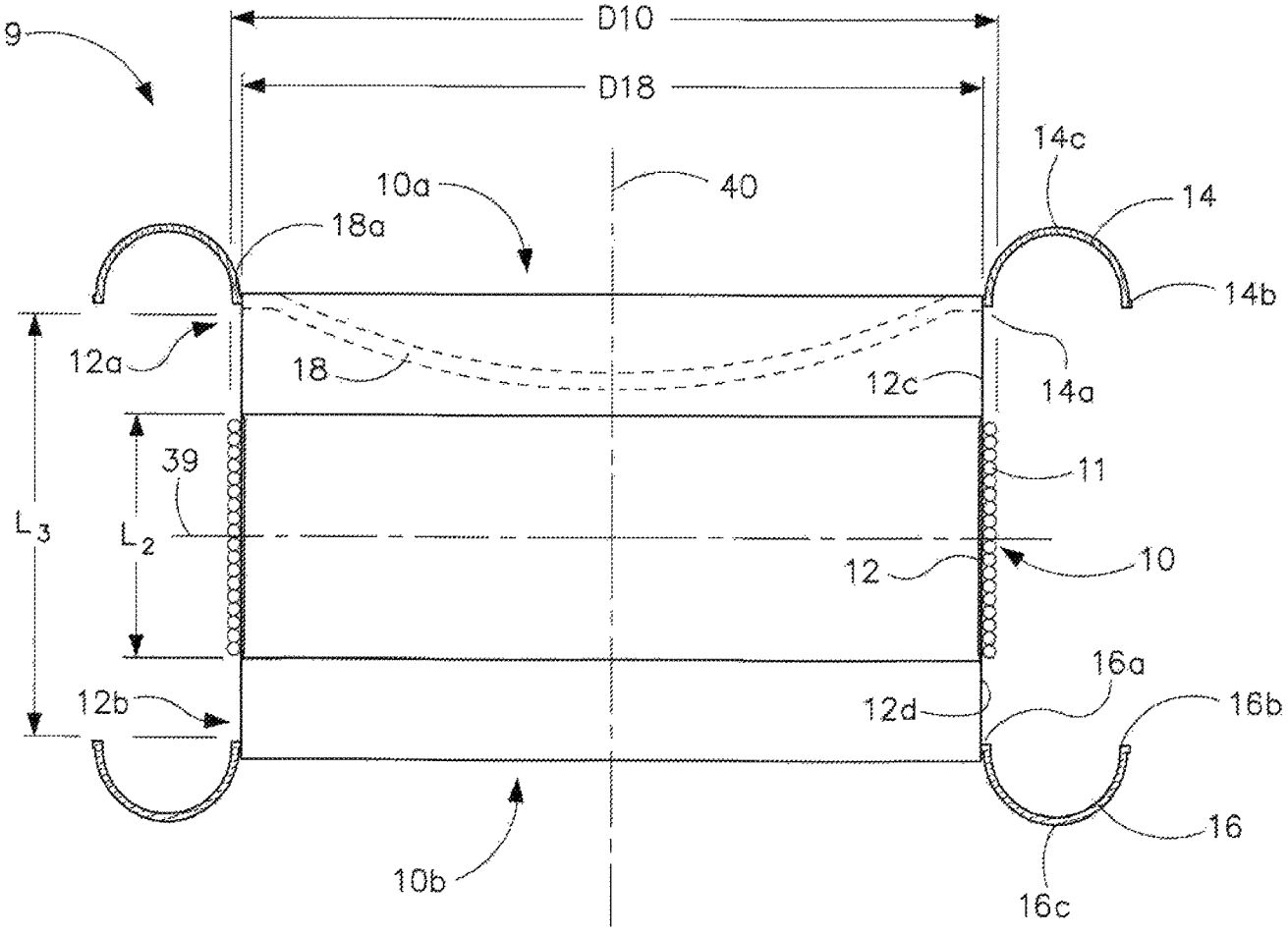
FIG. 5 is a cross-sectional view of an embodiment of a voice coil support system of this disclosure.

FIG. 5 is a cross-section view of one embodiment of a voice coil support system 9 of this disclosure. The voice coil support system 9 comprises the voice coil 10 and opposing upper and lower suspension members 14, 16, which may have a mirror like image with opposing symmetrical shapes about the radial axis 39. The outer edge 14*b* of the upper suspension 14 may be configured for adhesion to a speaker driver frame (not shown), preferably above a motor assembly (not shown). The inner edge 14*a* of the upper suspension 14 may be adhered to the outer periphery 12*d* of the former 12 at the upper end 12*a* of the former 12. The outer edge 16*b* of the lower suspension 16 may be configured for adhesion to a speaker driver frame (not shown), preferably below a motor assembly (not shown). The inner edge 16*a* of the lower suspension 16 may be adhered to the outer periphery 12*d* of the former 12 at the lower end 12*b* of the former 12. Thus, the voice coil 10, which comprises a winding 11 and a former 12, may be supported on its upper and lower ends 10*a*, 10*b* by the upper and lower suspension members 14, 16. The voice coil 10 may optionally have a collar (not shown). For voice coils without collars, the ends of the former 12*a*, 12*b* and ends of the voice coil 10*a*, 10*b* are coincident. The voice coil support system 9 illustrated in FIG. 5, is substantially symmetrical about its long axis 40 and radial axis 39. The length of the winding $L_2$ may be at least twenty percent of the length of the former $L_3$ Preferably the length of the winding $L_2$, may be from about twenty percent to about 90 percent of the length of the former $L_3$. The cone 18, shown in phantom, may be adhered to voice coil support system 9 at the inner periphery 12*c* of the former 12 at the upper end 12*a* of the former 12 along the circumferential edge 18*a* of the cone 18. Thus, the cone is supported only by the voice coil support system. In the illustrated embodiment, the diameter of the voice coil D10 is larger than the diameter of the cone D18. The upper suspension member crown 14*c* faces upward and the lower suspension member crown 16*c* faces downward.

FIG. 6A is a cross-sectional top view of an outer ring 20 for use in a frame embodiment of this disclosure. The outer ring 20 illustrated is a preferable hoop and spoke configuration. The outer perimeter of the hoop and spoke 20*c* may form an outer edge 20*b*' of the outer ring 20 that may have optional opening 20*f* (not shown) for fasteners which may be used to attach the outer ring 20 to the shank area 7 of the j-beams 6 of the frame 2 as seen in FIG. 2 to the left of the long axis 40 or the outer ring 20 may be attached to the frame 2 with an adhesive as seen to the right of the long axis 40 in FIG. 2. The outer ring 20 as illustrated with a hoop 20*e* may have an inner perimeter forming an inner edge 20*a* of the outer ring 20. A first magnet system 24 (not shown) may be attached to the inner edge 20*a* of the outer ring 20.

Figure 6B:
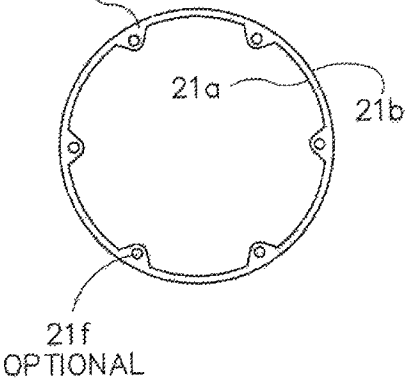
FIG. 6B is a cross-sectional top view of an inner ring of a frame embodiment of this disclosure.

FIG. 6B is a cross-sectional top view of an inner ring 21 for use in a frame embodiment of this disclosure. A second magnet system 26 (not shown) may be attached to the outer edge 21*b* of the inner ring 21. The inner edge 21*a* of the inner ring 21, may have optional openings 21*f* for use with fasteners (not shown) to attach the inner ring 21 to a hook area 36 of the j-beams 6 of the frame 2 (not shown). Alternatively, the inner ring may be adhered to a frame (not shown).

FIG. 6C is a cross-sectional top view of an upper ring 3 for use in a frame embodiment of this disclosure. The upper ring 3 may be adapted for mounting a speaker driver (not shown) to a speaker cabinet (not shown) through the optional opening 3*f* in the ring 3. The upper ring 3 may be integrally formed with a frame (not shown), opening 30*f*, illustrated in FIG. 6C, may be provided in the upper ring 3 which aligns with opening 7*f* in the shank area 7 of the j-beam 6 use with fasteners (not shown) to attach the upper ring 3 to a j-beam 6 of a frame 2 (not shown). The openings 30*f* may be in a polygonal arrangement, for example a hexagon, as seen in FIG. 6C. The inner edge 3*a* of upper ring 3 may be adapted to provide a surface for adhesion of the outer edge 14*b* of the upper suspension 14 (not shown).

Figure 6D:
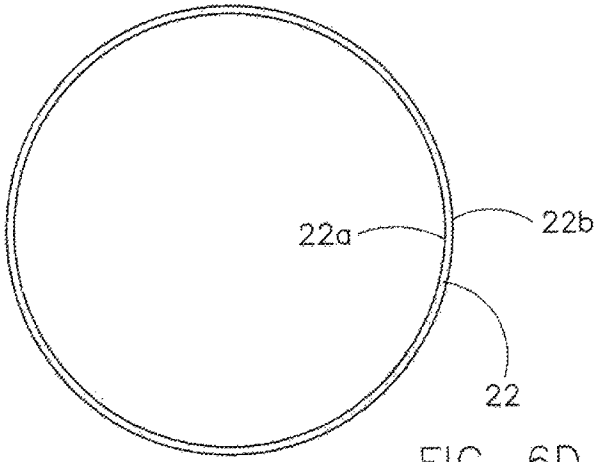
FIG. 6D is a cross-sectional top view of a lower ring of a frame embodiment of this disclosure.
Figure 6A:
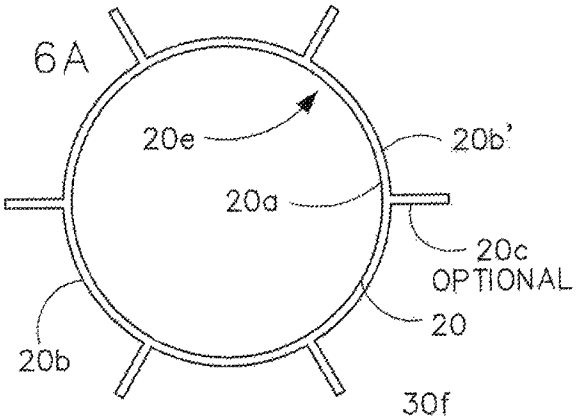
FIG. 6A is a cross-sectional top view of an embodiment of an outer ring of a frame embodiment of this disclosure having a hoop and spoke configuration.

FIG. 6D is a cross-sectional top view of a lower ring 22 for use with a frame embodiment of this disclosure. The outer edge 22*b* of the lower ring 22 may be inserted in a recess 7*n* at the lower end 6*b* of a j-beam 6 (See FIG. 6E.) to facilitate arrangement of the j-beams 6 and provide frame rigidity. The inner edge 22*a* of the lower ring 22 may provide a surface for adhesion of the outer edge 16*b* of the lower suspension 16 (not shown).

FIG. 6E is a cross-sectional side view of a j-beam 6 for use with a frame embodiment of this disclosure. The j-beam 6 may have a shank area 7 and hook area 36. The j-beam 6 may also have an upper edge 36*a* atop the hook area 36 and an upper edge 7*a* atop the shank area 7. A recess 7*n* may be formed within the inner periphery 7*d* of the shank area 7 of the j-beam 6 for insertion of the lower ring (See also FIG. 6D). The lower end 6*b* of the j-beam 6 has a base 34 illustrated by the flattened area. The j-beam 6 may have optional openings 7*f*, 36*f* for fasteners.

Figure 6F:
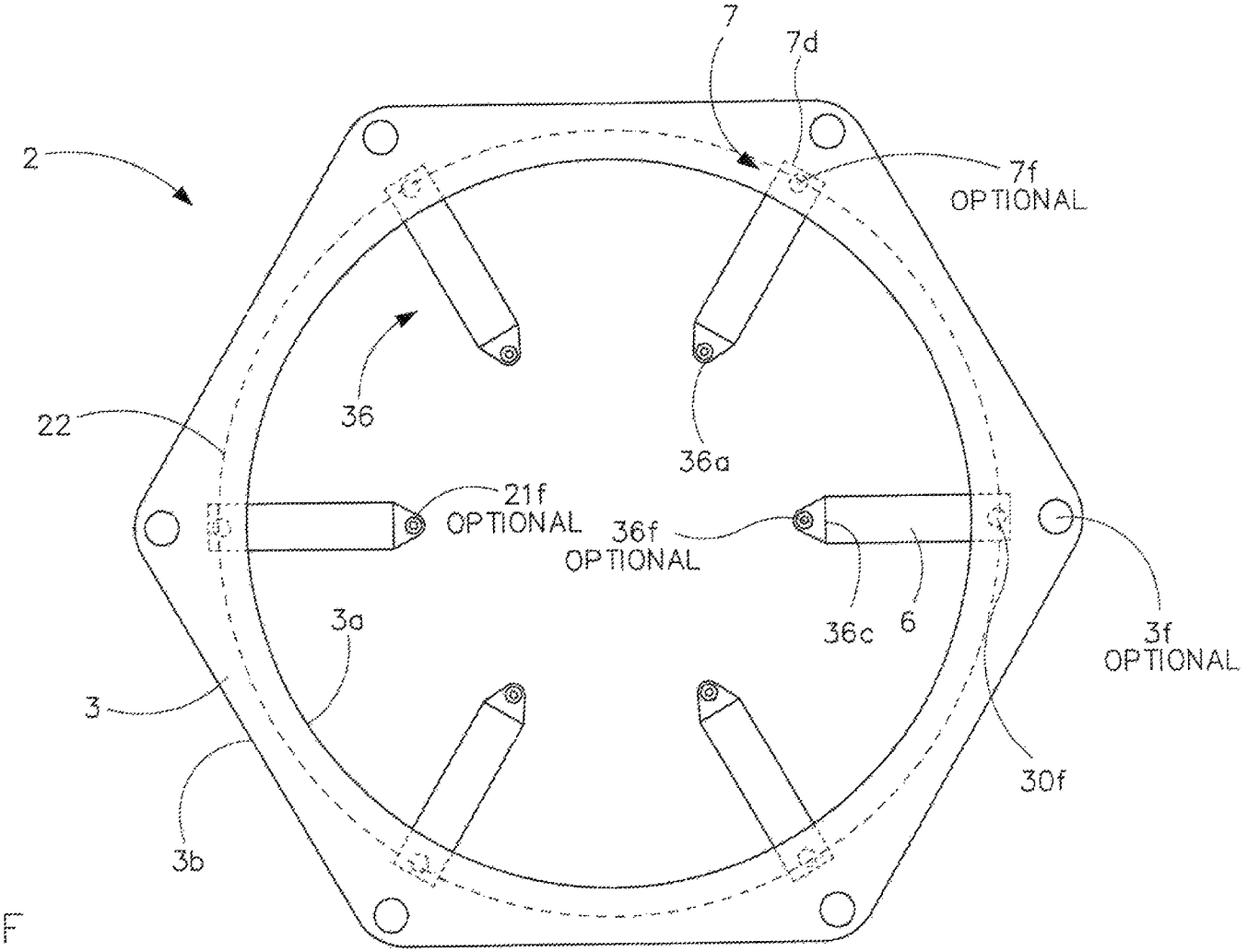
FIG. 6F is a top view of an assembled frame embodiment of this disclosure using six j-beams.

FIG. 6F is a top view of an assembled frame 2 embodiment of this disclosure using six j-beams 6. The j-beams 6 may be held substantially equidistant by the upper ring 3 and the lower ring 22 (shown in phantom) with the hook area 36 of each j-beam 6 arranged inwardly from the outer edge 3*b* and the inner edge 3*a* of the upper ring 3. The shank area 7 of the j-beam 6 is shown in phantom. Optional fastener openings 30*f* and 7*f* and 21*f* and 36*f* may be provided for attaching the upper edge 7*a* of shank area 7 of the j-beam 6 to the upper ring 3 and the upper edge 36*a* of the hook area 36 of the j-beam 6 to the inner ring 21, respectively. Also illustrated is an opening 3*f* in the upper ring 3 for fasteners to mount the speaker driver to a speaker cabinet (not shown).

FIG. 7 The speaker driver frame 2 comprising three j-beams 6, a motor assembly 4 and a magnetic gap 5 are illustrated. The j-beams 6, as depicted in FIG. 6E, may have an upper end 6*a*, a lower end 6*b*, a shank area 7, a recess 7*n* within the inner periphery 7*d* of the shank area 7, and a hook area 36. The lower end 6*b* of the j-beam 6 may have a base 34 illustrated by the flattened area. As shown in FIG. 7, the frame 2 may be assembled using an upper ring 3, a lower ring 22, an outer ring 20 and an inner ring 21. The j-beams 6 are preferably arranged equidistant from each other along a radial axis 39. The upper ring 3 in FIG. 7 may be attached to the j-beams 6 using means known in the art. Openings 30*f* and 7*f*, 20*f*, and 21*f* and 36*f* may be provided for fasteners for attaching the upper ring 3 to the shank area 7 of the j-beam 6, the outer ring 20 to the shank area 7 of the j-beam 6 and the inner ring 21 to the hook area 36 of the j-beam 6, respectively. An opening 3*f* may be provided in the upper ring 3 to mount the speaker driver to a speaker cabinet (not shown). The outer ring 20 may be used to attach the first magnet system 24 along the inner edge 20*a* of the outer ring 20. The inner ring 21 may be used to attach the second magnet system 26 along the outer edge 21*b* of the inner ring 21. The magnetic gap 5 is formed between the first and second magnet systems 24, 26.

Figure 9:
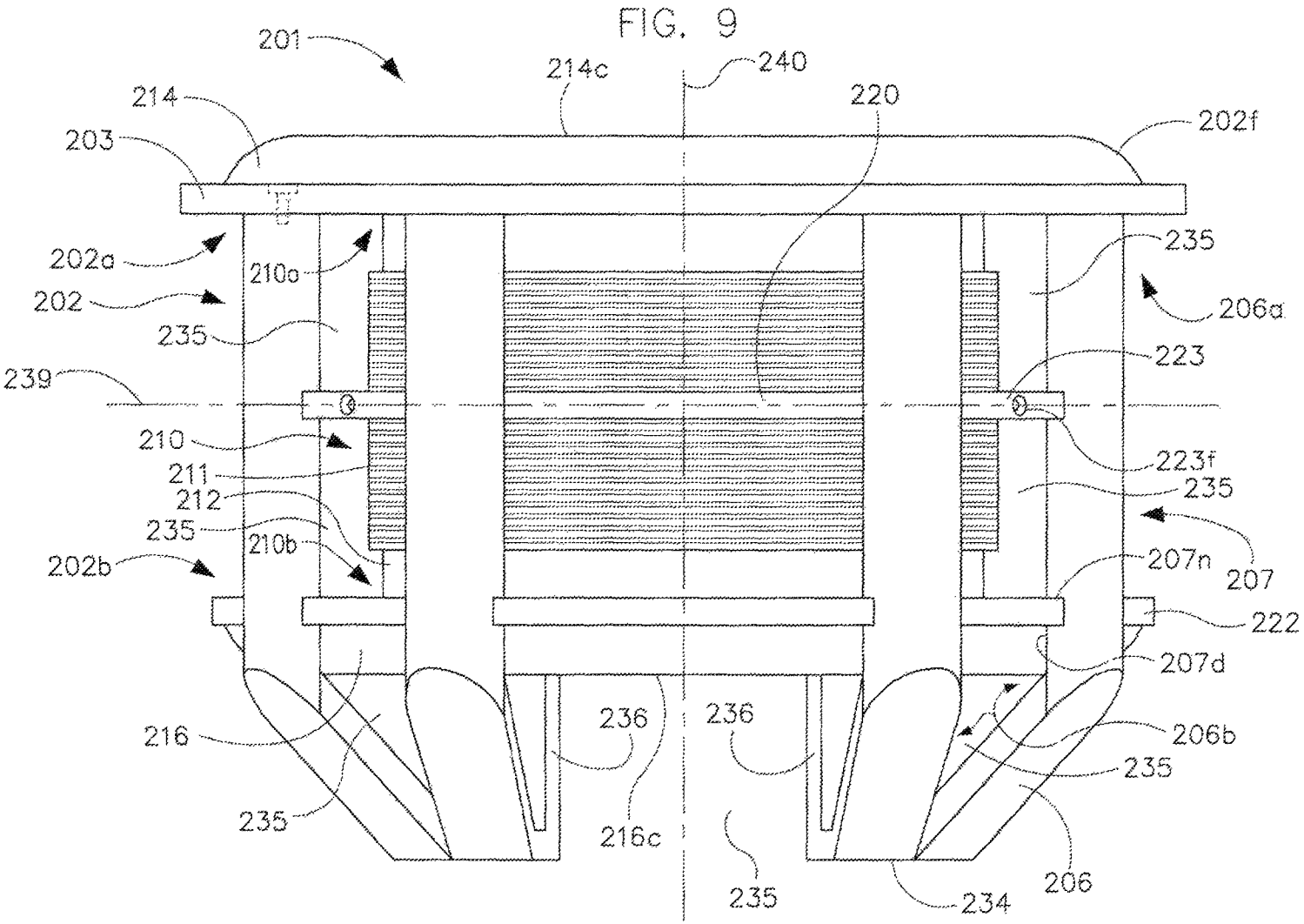
FIG. 9 is a front view of one embodiment of a speaker driver of this disclosure using an open coil design.

FIG. 9 is a front view of an alternate embodiment of the speaker driver 201 having j-beams 206, which merge at the base 234 to form shared hook areas 236. In this alternate embodiment, the symmetrical motor assembly (hidden by the outer ring), symmetrical voice coil support system, voice coil 210 and open coil frame design are similar to the components in FIG. 2. The alternate embodiment illustrates eight j-beams 206 (the back four being hidden from view by the front four), which merge at the base 234 to form four shared hook areas 236. In this embodiment, two j-beams 206 share a single hook area 236. Although the ratio of j-beam shanks 207 to shared hook areas 236 is typically two to one, other ratios may be used. The j-beams 206 may have an upper end 206*a*, a lower end 206*b*, a shank area 207, a recess 207*n* within the j-beam 206 inner periphery 207*d* and a shared hook area 236. The lower end 206*b* of the j-beam 206 has a base 234. The frame 202 may be assembled using at least four rings, an upper ring 203, a lower ring 222, an outer ring 220 and an inner ring 221 (hidden in this view by outer ring 220). The j-beams 206 of this embodiment are generally aligned with the long axis 240 and radially spaced apart from one another, excepting shared hook areas 236, arranged interiorly, which are integrally formed with the inner ring 221. (FIG. 10) The j-beams 206 form large interconnected air gaps 235 in the frame 202, unlike prior art drivers with cylindrical walls encircling the voice coil 210, which trap and absorb heat.

FIG. 9 also illustrates use of two suspension members 214, 216. These suspension members are known to those in the art as half roll surrounds. The two suspension members 214, 216 are arranged such that the crown the upper suspension member 214*c* is arranged in an opposing manner to the crown of the lower suspension member 216*c* like mirror images about the radial axis 239. The upper 214 and lower suspension members 216 may be respectively adhered between the voice coil 210 at the upper and lower ends 210*a*, 210*b* of the voice coil 210 and frame 202 on opposite sides of the motor assembly 204 (not shown). The two suspension members 214, 216 are preferably arranged to be symmetrical about both the long and radial axes of the speaker driver 201. The two suspension members 214, 216 support the voice coil 210 and the cone 218 (not shown), without use of any additional suspension members. Large interconnected air gaps 235 defined by the j-beams 206 are illustrated throughout the frame 202.

FIG. 10 is a perspective view of a preferred embodiment of an open coil frame 202; which, excepting the outer ring 220, is integrally formed. In this embodiment, the j-beams 206 merge at the base 234 to form shared hook areas 236. An upper ring 203, inner ring 221 and lower ring 222 integrally formed with the j-beams 206 are illustrated in FIG. 10. The shank areas 207 of the j-beam may have cross-members 223 with through holes 223*f* between j-beams 206 having shared hook areas 236 for aligning and fastening the outer ring 220 to the frame 202. FIG. 10A is a bottom view of this preferred embodiment illustrating the merging of two j-beam lower ends 206*b* at the base 234 into a shared hook area 236. In an alternate embodiment, the inner ring 221 and the outer ring 220 are separate from the frame 202 as seen in FIG. 12B. FIG. 10B is a top view of outer ring 220 depicting four spokes, used as standoff plates 220*c*, extending radially outward from the outer ring outer edge 220*b*. Each standoff plate 220*c* may have openings 220*f* provided for receiving fasteners for attaching the outer ring 220 to the shank area cross-member 223 of the j-beam 206. The standoff plates 220*c* are used to position the first magnet system.

Figure 11:
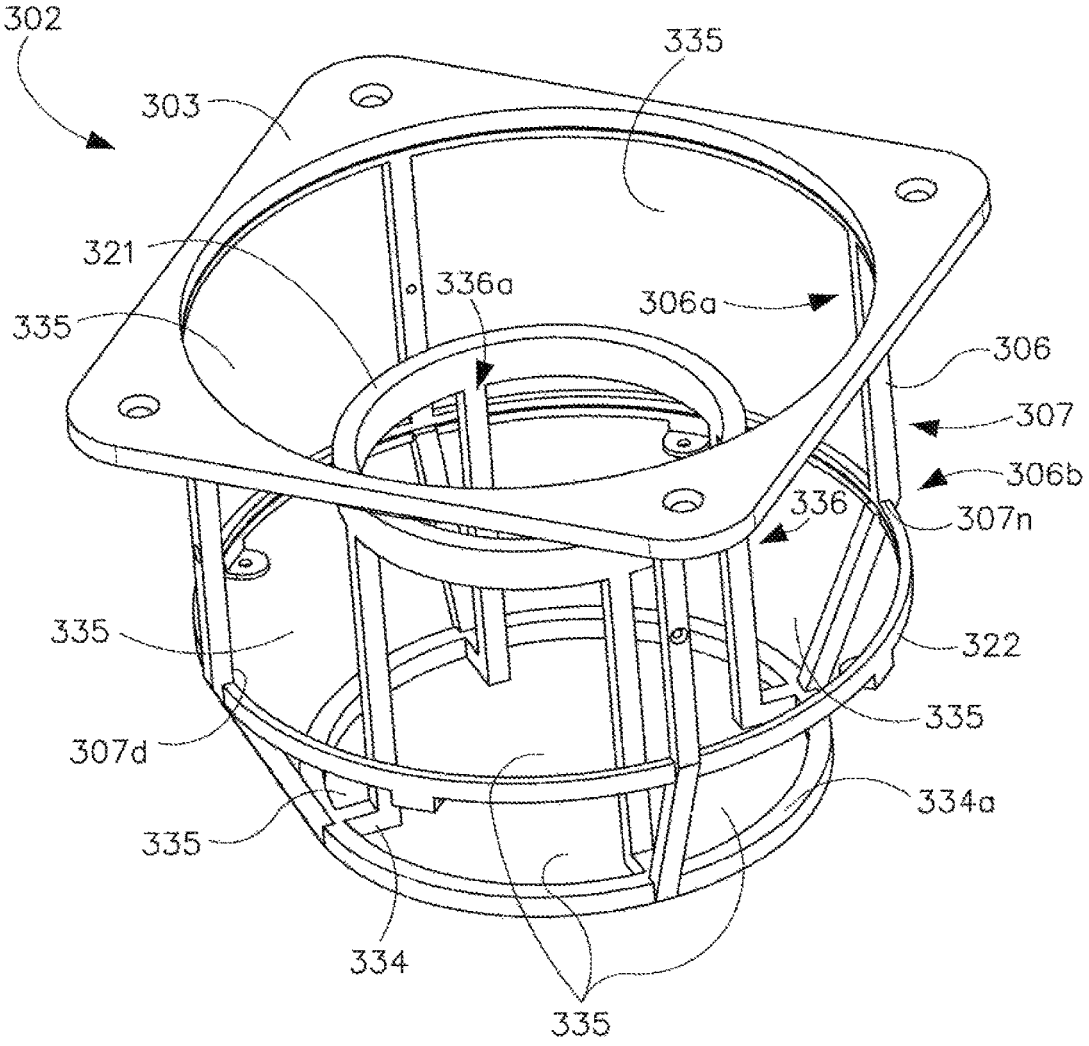
FIG. 11 is a perspective view of one embodiment of a speaker driver frame with a base ring.

FIG. 11 is a perspective view of an alternate embodiment of a frame 302. This embodiment also illustrates an upper ring 303, inner ring 321 and lower ring 322 integrally formed with the j-beams 306. The j-beams 306 may have an upper end 306*a*, a lower end 306*b*, a shank area 307, a recess 307*n* within the inner periphery of the shank area 307*d* near the lower end of the j-beam 306*b* before the bend of the j-beam, a hook area 336 and a base 334. In this embodiment, the bases of the j-hooks 334 are integrally formed with a base ring 334*a*. The shank areas 306 of this embodiment are generally aligned with the long axis 340 (not shown). The j-beams 206 are radially spaced apart from one another with the hook area 336 arranged interiorly and integrally formed with the inner ring 321 disposed on the upper end of the hook area 336*a*. The j-beams 306 form large interconnected air gaps 335 in the frame 302.

Figure 12A:
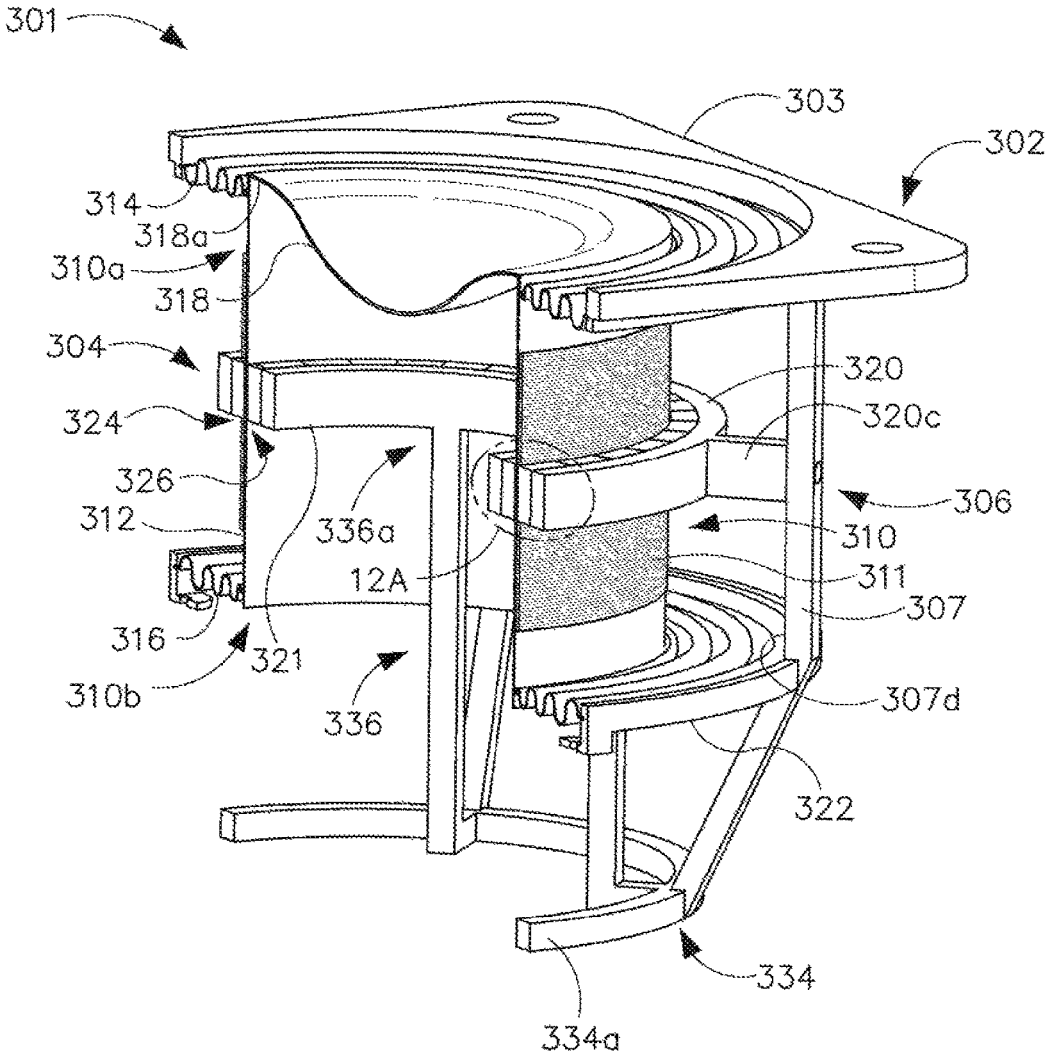
FIG. 12A is a partial perspective view of one embodiment of a speaker driver, which illustrating the open voice coil frame; the symmetrical voice coil suspension system using spiders for supporting the voice coil and cone; and the first and second magnet systems.

FIG. 12A is a partial perspective view of an alternate embodiment of a speaker driver 301, having the frame 302 of FIG. 11, which illustrates the open voice coil frame design. The speaker driver 301 includes a frame 302; a motor assembly 304; a voice coil 310, an upper suspension 314, a lower suspension 316 and a cone 318. The concentrically disposed voice coil 310 is typically made by winding wire around a bobbin, known as the winding 311 and former 312, respectively. FIG. 12 illustrates an embodiment using an overhung voice coil. The motor assembly 304 comprises two annular magnet systems 324, 326 concentrically disposed within the frame 302 about radial axis 339. The voice coil 310 is shown substantially bisecting a magnetic gap 305 formed between the two magnet systems 324, 326.

FIG. 12A also illustrates use of two suspension members 314, 316 wherein the upper suspension member 314 and the lower suspension member 316 have corrugated or sinusoidal shapes. These suspension members are known to those in the art as spiders. The two suspension members 314, 316 are arranged such that the crowns of successive arches of the upper suspension members are arranged in an opposing manner to the lower suspension member like mirror images about the radial axis 339. The upper 314 and lower suspension members 316 may be respectively adhered between the voice coil 310 at the upper and lower ends 310*a*, 310*b* of the voice coil 310 and frame 302 on opposite sides of the motor assembly 304. The two spiders illustrated are arranged to be symmetrical about both the long and radial axes of the speaker driver 301. The two suspension members 314, 316 support the voice coil 310 and the cone 318, without use of any additional suspension members.

The motor assembly 304 illustrated in FIG. 12B comprises two permanent annular ring magnets systems 324, 326. The first magnet system 324 may be disposed outside the second magnet system 326. As illustrated in FIG. 12B, each magnet system 324, 326 may be made from a plurality of arc magnets 28. The plurality of arc magnets 28 forming the first magnet system 324 may be attached to the inner edge 320*a* of the outer ring 320. Similarly, the plurality of arc magnets 28 forming the second magnet system 236 may be attached to the outer edge 321*b* of the inner ring 321 to form an annular ring or the arc magnets 28 may be attached to each other to form an annular ring before attachment to the outer edge of the inner ring 321*b*. In an alternate embodiment, the plurality of arc magnets 28 may be attached to each other to form an annular ring before attachment to the inner edge 320*a* of the outer ring 320 and before attachment to the outer edge of the inner ring 321*b*.

An embodiment of the motor assembly 304 illustrated in FIGS. 12B and 12C3 is physically and magnetically symmetrical about the long axis 340 and radial axis 339. FIG. 12C illustrates a magnetic gap 305 formed between the first and second magnet systems 324, 326, which is bisected by voice coil 310. The length of the first and second magnet systems 324, 326 illustrated have the same length L1 as the outer and inner rings 320, 321 and the magnetic gap 305. In preferable embodiments illustrated in FIGS. 12B and 12C, the plurality of magnets 28 on both sides of magnetic gap 305 have the same composition and same magnetic strength. Another aspect of this preferable embodiment is for the outer and inner rings 320, 321 to be made of non-ferromagnetic material. Use of these materials combined with the geometry illustrated in FIGS. 12B and 12C form a substantially symmetrical magnetic motor assembly. FIG. 12C also illustrates an embodiment of an overhung voice coil 310 wherein the amount of winding 311 above and below the motor assembly 304 about the radial axis (not shown) of the driver 301 is substantially equal. The radial polarities of the first and second magnet systems 324, 326 are illustrated in FIG. 12C wherein the north pole of the first magnet system 324 faces the voice coil 310 and the south pole of the second magnet system 326 faces the voice coil 310. In an alternate embodiment, the polarities may be reversed.

Turning back to FIG. 12B, the outer ring 320 may be used to attach the first magnet system 324. The first magnet system outer edge 324*b* may be preferably attached to the inner edge 320*a* of the outer ring 320. The outer ring 320 may be annular shaped, but preferably has a hoop and spoke design. The outer edge of the spoke area 320*c* of the outer ring 320, which may be used as a standoff plate, may be attached to the inner periphery 307*d* of the shank area 307 by adhesive or fasteners as illustrated on the right side of FIG. 12A. The second magnet system inner edge 326*a* may be attached to the inner ring outer edge 321*b* attached using adhesive or attached using fasteners. The outer ring 320 and inner ring 231 may be concentrically arranged substantially midway between the upper ring 303 and the lower ring 322 in an embodiment of the speaker driver.

Figure 13:
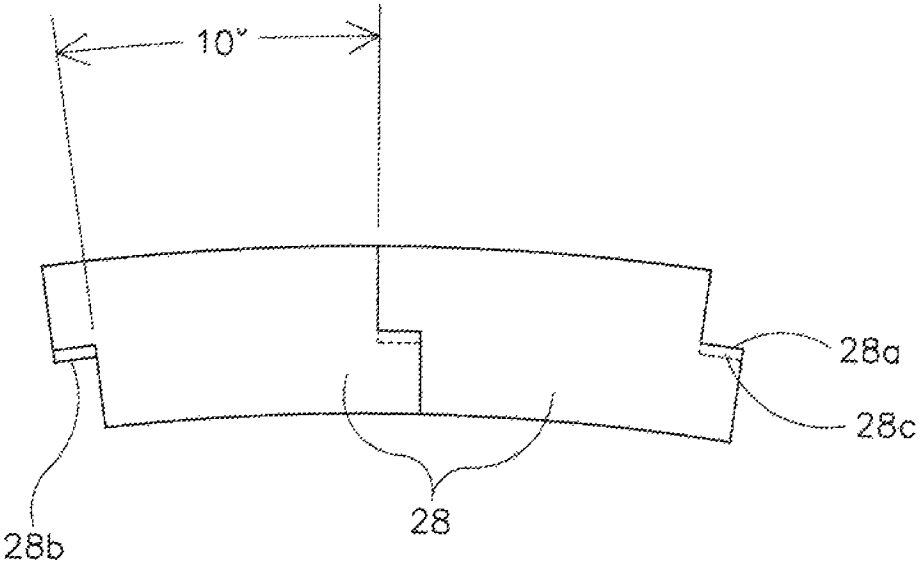
FIG. 13 is a perspective view of two radially polarized magnets with shoulders, protrusions and recesses.

Turning to FIG. 13, the plurality of arc magnets 28 are shown in perspective view. The arc magnets 28 may be held together magnetically preferably using shoulder portions 28*a*. The length of the shoulder L28 being from about 10% to about 15% the length of the arc magnet L28. Optionally, the arc magnet shoulders 28*a* may have protruding areas 28*b* that fit into recessed area 28*c* for interlocking the plurality of arc magnets. The arc magnets preferably have ten degrees of arc.

Figure 14A:
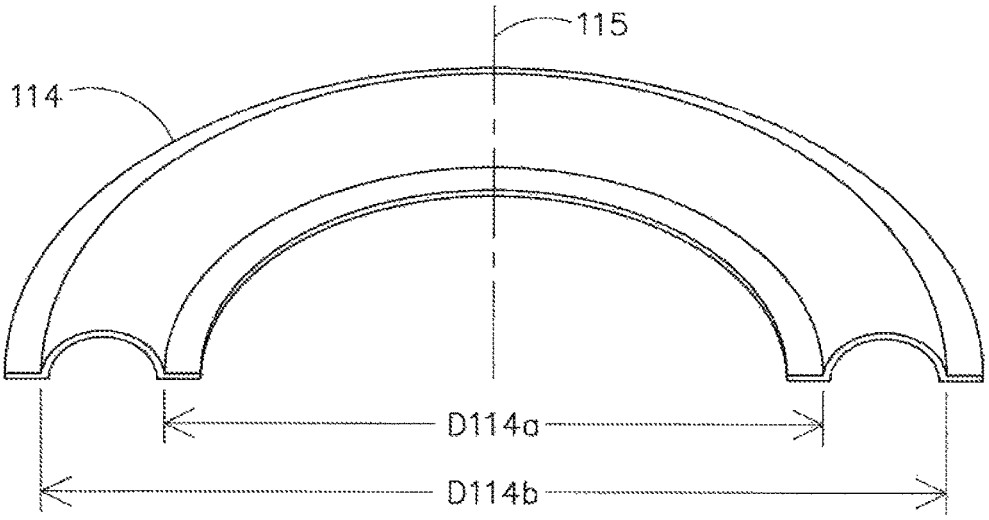
FIG. 14A is a perspective view of an upper suspension member illustrating the difference in diameters between the outer portion of a half roll suspension and the inner portion of a half roll suspension.
Figure 14B:
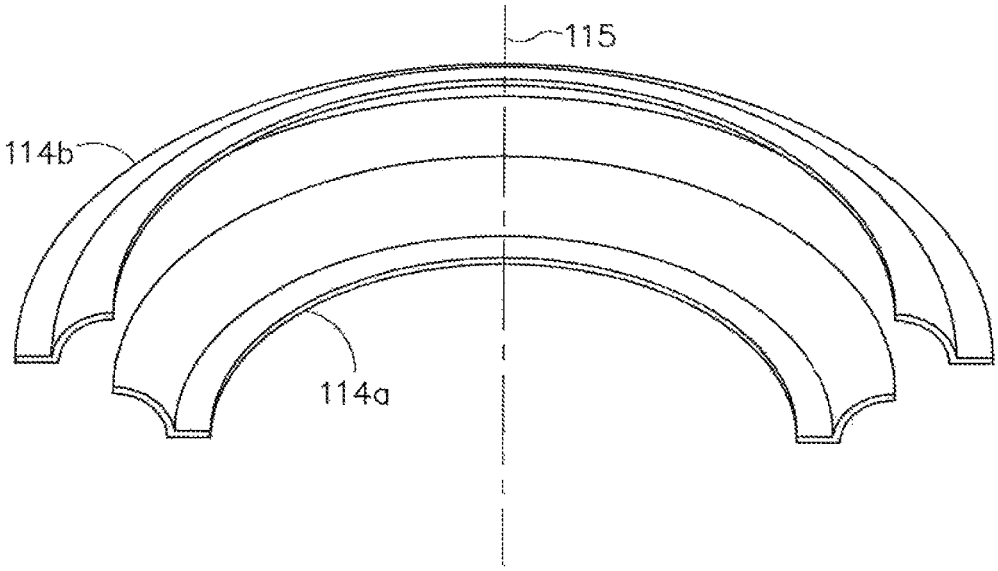
FIG. 14B is another perspective view of an upper suspension member illustrating the difference in diameters between the outer portion of a half roll suspension and the inner portion of a half roll suspension.

FIG. 14A illustrates a half roll suspension member 114. FIG. 14B illustrates a half roll suspension member bisected into two segments 114*a* and 114*b*. The inner diameter D114*a* of segment 114*a* is smaller than the outer diameter D114*b* of segment 114*b*. Because of the difference in diameters, the amount of material being pushed and pulled by the cone differs between the inner 114*a* and outer 114*b* segments of the suspension member 114. This structural difference between the segments is thought to be a contributing reason for non-symmetrical response of suspension members, as the suspension member changes position relative to voice coil position as it moves through downward and upward excursions.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

I claim:

1. A speaker driver comprising:

(a) a frame;

(b) a motor assembly disposed within said frame, said motor assembly having a first magnet system polarized along the radial axis of the speaker driver, the first magnet system comprising permanent magnetic material and non-ferromagnetic material and a second magnet system polarized along the radial axis of the speaker driver, the second magnet system comprising permanent magnetic material and non-ferromagnetic material, the first and second magnet systems being concentrically arranged to form a magnetic gap wherein the length of the first and second magnet systems are substantially equal to the length of the magnetic gap;

(c) a voice coil, said voice coil comprising a winding and a former, disposed moveably within a magnetic gap formed within said motor assembly;

(d) an upper suspension member adhered to said frame and said former above said motor assembly for supporting said voice coil and a cone;

(e) a lower suspension member adhered to said frame and said former below said motor assembly for supporting said voice coil and said cone; and wherein said cone is adhered to said upper suspension.

2. The speaker driver of claim 1 wherein said winding is exposed excepting the length of said magnetic gap.

3. The speaker driver of claim 1 wherein said upper suspension and said lower suspension are disposed substantially equidistant from said first and second magnetic systems along said long axis of said speaker driver and wherein said upper and lower suspension members have opposing mirrored shapes.

4. The speaker driver of claim 1 having a single voice coil which is not characterized as a split gap voice coil.

5. The speaker driver of claim 1 wherein said motor assembly is magnetically symmetrical about a long axis and radial axis of said speaker driver.

6. The speaker driver of claim 1 wherein the first and second magnet systems comprise a plurality of arc magnets having shoulder portions magnetically joined forming a first and second annular ring.

7. The speaker driver of claim 6 wherein said shoulder portions have at least one protruding area and at least one recessed area mated for magnetically interlocking said plurality of arc magnets.

8. The speaker driver of claim 1 wherein said frame comprises a plurality spaced apart j-beams disposed for providing air gaps between said j-beams substantially from an upper end of said frame to a lower end of said frame exterior to said voice coil and between said j-beams interior to said voice coil.

9. The speaker driver of claim 1 wherein the frame is characterized by an open structure exposing said voice coil.

10. A speaker driver of claim 1 wherein said speaker driver is characterized by an open coil frame design having an absence of material proximate said voice coil such that over about 50% of a winding area of said voice-coil is exposed for cooling.

11. A speaker driver of claim 1, said speaker driver having over from about 50% to about 95% of a winding area of said voice-coil is exposed.

12. The speaker driver of claim 1 wherein the upper suspension member and the lower suspension member have opposing mirrored shapes disposed substantially equidistant from the first and second magnetic systems.

13. The speaker driver of claim 1 wherein said frame is characterized by an open structure configured to expose an inner surface of said voice coil and an outer surface of said voice coil used in operation within said magnetic gap of said speaker driver.

* * * * *